US010648771B2

(12) United States Patent
Mikroulis

(10) Patent No.: US 10,648,771 B2
(45) Date of Patent: May 12, 2020

(54) FIREARM RETICLE

(71) Applicant: Dimitri Mikroulis, Idyllwild, CA (US)

(72) Inventor: Dimitri Mikroulis, Idyllwild, CA (US)

( * ) Notice: Subject to any disclaimer, the term of this patent is extended or adjusted under 35 U.S.C. 154(b) by 0 days.

(21) Appl. No.: 16/277,940

(22) Filed: Feb. 15, 2019

(65) Prior Publication Data

US 2019/0257618 A1 Aug. 22, 2019

Related U.S. Application Data

(60) Provisional application No. 62/631,866, filed on Feb. 18, 2018.

(51) Int. Cl.
*F41G 1/473* (2006.01)
*F41G 1/38* (2006.01)

(52) U.S. Cl.
CPC ..... *F41G 1/473* (2013.01); *F41G 1/38* (2013.01)

(58) Field of Classification Search
CPC ..... F41G 1/473
USPC ..... 235/404; 42/122, 133, 141, 131, 111; 89/41.17
See application file for complete search history.

(56) References Cited

U.S. PATENT DOCUMENTS

| | | | |
|---|---|---|---|
| 3,392,450 | A | 7/1968 | Herter |
| 4,263,719 | A | 4/1981 | Murdoch |
| 5,491,546 | A | 2/1996 | Wascher et al. |
| 5,920,995 | A | 7/1999 | Sammut |
| 6,032,374 | A | 3/2000 | Sammut |
| 6,357,158 | B1 | 3/2002 | Smith, III |
| 6,445,497 | B1 | 9/2002 | Adda |
| 6,453,595 | B1 | 9/2002 | Sammut |
| 6,591,537 | B2 | 7/2003 | Smith |
| 6,681,512 | B2 | 1/2004 | Sammut |
| 6,729,062 | B2 | 5/2004 | Thomas et al. |
| 7,069,684 | B2 | 7/2006 | Smith, III |
| 7,100,320 | B2 | 9/2006 | Verdugo |
| 7,171,775 | B1 | 2/2007 | Lacorte |
| 7,434,345 | B2 | 10/2008 | Verdugo |
| 7,603,804 | B2 | 10/2009 | Zaderey et al. |
| 7,654,029 | B2 | 2/2010 | Peters et al. |
| 7,748,155 | B2 | 7/2010 | Cole |
| 7,832,137 | B2 | 11/2010 | Sammut et al. |
| 7,877,886 | B1 | 2/2011 | Hamilton |
| 7,937,878 | B2 | 5/2011 | Sammut et al. |
| 7,946,073 | B1 | 5/2011 | Buck |
| 8,091,268 | B2 | 1/2012 | York |
| 8,109,029 | B1 | 2/2012 | Sammut et al. |
| 8,353,454 | B2 | 1/2013 | Sammut et al. |
| 8,656,630 | B2 | 2/2014 | Sammut |
| D700,944 | S | 3/2014 | Mikroulis |
| D700,945 | S | 3/2014 | Mikroulis |
| 8,707,608 | B2 | 4/2014 | Sammut et al. |
| D716,409 | S | 10/2014 | Mikroulis |
| D720,033 | S | 12/2014 | Mikroulis |

(Continued)

*Primary Examiner* — Allyson N Trail
(74) *Attorney, Agent, or Firm* — The Compton Law Firm, P.C.; Scott D. Compton

(57) ABSTRACT

The present application is directed to a firearm reticle operationally configured to correlate one or more of horizontal range estimation information, vertical range estimation information, bullet drop compensation information, wind adjustment information, target travel speed lead information, fire correction information, and combinations thereof for a target object. The firearm reticle is operationally configured for target acquisition of a target object that may be oriented in a plurality of firing positions.

15 Claims, 11 Drawing Sheets

(56) References Cited

U.S. PATENT DOCUMENTS

| | | | |
|---|---|---|---|
| 8,910,412 | B2 | 12/2014 | Mikroulis |
| 8,966,806 | B2 | 3/2015 | Sammut et al. |
| D726,280 | S | 4/2015 | Mikroulis |
| D745,105 | S | 12/2015 | Mikroulis |
| 9,335,123 | B2 | 5/2016 | Sammut |
| D758,523 | S | 6/2016 | Mikroulis |
| D767,077 | S | 9/2016 | Mikroulis |
| D767,659 | S | 9/2016 | Mikroulis |
| D767,660 | S | 9/2016 | Mikroulis |
| D767,661 | S | 9/2016 | Mikroulis |
| D768,221 | S | 10/2016 | Mikroulis |
| D803,973 | S | 11/2017 | Kedairy |
| 2005/0091903 | A1 | 5/2005 | Smith, III |
| 2005/0188601 | A1 | 9/2005 | Verdugo |
| 2006/0026887 | A1 | 2/2006 | Verdugo |
| 2007/0022651 | A1 | 2/2007 | Verdugo |
| 2008/0202011 | A1 | 8/2008 | Shepherd |
| 2011/0107649 | A1 | 5/2011 | Buck |
| 2011/0132983 | A1 | 6/2011 | Sammut et al. |
| 2011/0296733 | A1 | 12/2011 | York |
| 2012/0137567 | A1 | 6/2012 | Sammut |
| 2012/0144720 | A1 | 6/2012 | Lacorte |
| 2013/0033746 | A1 | 2/2013 | Brumfield |

FIREARM RETICLE

CROSS-REFERENCES TO RELATED APPLICATIONS

This application claims benefit of U.S. Provisional Patent Application Ser. No. 62/631,866, filed on Feb. 18, 2018, the content of which is hereby incorporated by reference in its entirety.

STATEMENT REGARDING FEDERALLY SPONSORED RESEARCH OR DEVELOPMENT

Not applicable.

BACKGROUND OF THE INVENTION

The present application relates generally in the field of reticles for telescopic and other optical sighting systems for use on firearms.

Firearm reticles are well known in the art. Reticle types vary from the traditional "crosshair" markings to dots, circles, other geometric shapes and cross lines or any combination of the above. Some reticles range estimate at a selected distance only in terms of a known or estimable width of a known target or only in a terms of a known or estimable height of a known target, which may result in a false reading if the target, e.g., an individual such as an enemy combatant, is one that is not facing a shooter according to the selected requirements of the reticle or if the enemy combatant is running or if his/her legs or feet or torso are not exposed for view. In addition, typical reticles can require various calculations that prolong or delay optimum target acquisition timing.

Overcoming such shortcomings is desired.

SUMMARY OF THE INVENTION

The present application is directed to a firearm reticle including a central scale operationally configured for horizontal range estimation and aiming of a target according to a selected center mass of the target at one or more predetermined distances; and one or more side scales operationally configured for vertical range estimation of the target according to a selected full height and half height of the target at the one or more predetermined distances; the central scale including a first measurement mark for horizontal range estimation of the target at a base distance, wherein the first measurement mark is operationally configured to provide one or more target aiming points at one or more distances other than the base distance.

The present application is also directed to a firearm reticle for acquisition of a target having pre-set parameters including horizontal range estimation information, vertical range estimation information, bullet drop compensation information, wind adjustment information, target travel speed lead information, and fire correction information according to a particular package, the reticle having a central scale including (1) a first measurement mark operationally configured to horizontally range estimate the target according to a predetermined average center mass of the target at a base distance of the reticle and provide a first target aiming point and a second target aiming point of the reticle at distances other than the base distance and (2) a second measurement mark operationally configured to provide a third target aiming point of the reticle at the base distance.

The present application is also directed to a calculation free method of decreasing time on target for a user of a firearm comprising (1) providing a firearm reticle for use with a firearm of a particular package, the firearm reticle having pre-set parameters including horizontal range estimation information, vertical range estimation information, bullet drop compensation information, wind adjustment information, target travel speed lead information, and fire correction information, the reticle having a central scale including (a) a first measurement mark operationally configured to horizontally range the target according to a predetermined average center mass of the target at a base distance of the reticle and provide a first target aiming point and a second target aiming point of the reticle at distances other than the base distance, (b) a second measurement mark operationally configured to provide a third target aiming point of the reticle at the base distance, and (c) one or more side scales including a one or more vertical marks operationally configured to vertically range the target according to a selected full height and half height of the target at one or more distances other than the base distance, wherein the one or more vertical marks are operationally configured as lead marks and as angular measurement marks from the first measurement mark; and (2) acquiring a target using the reticle according to the firing position of the target, the distance of the target from the reticle and observed cross wind velocity.

DESCRIPTION OF THE INVENTION

Figure 1:
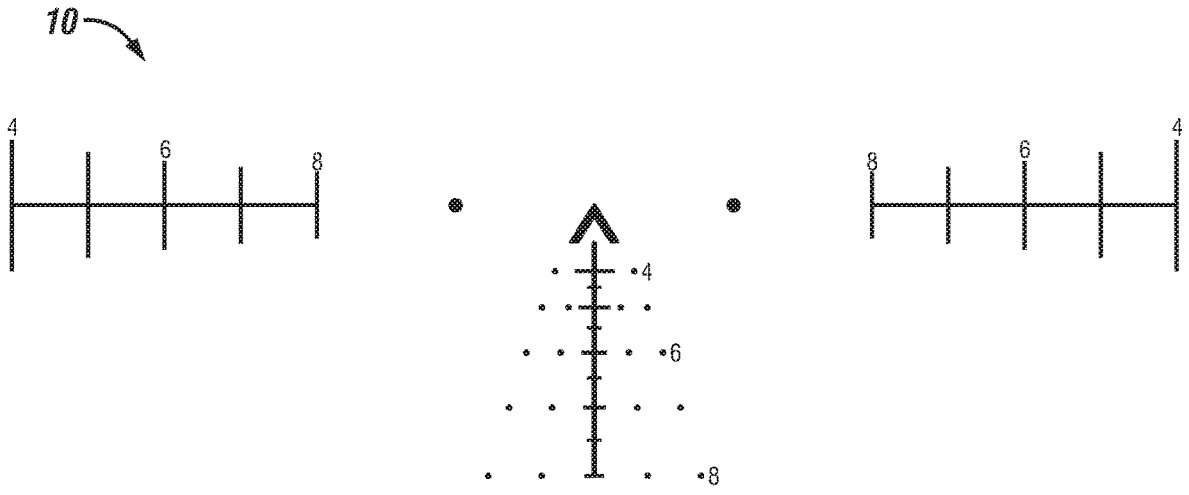
FIG. 1 is a plan view of an embodiment of the firearm reticle of the present application for use with a weapon system.

Before describing the invention in detail, it is to be understood that the invention is not limited to particular embodiments. It is also to be understood that the phraseology and terminology used herein is for the purpose of describing particular embodiments only, and is not intended to be limiting. As used in this specification, the term "reticle" or "reticule" in relation to firearms refers to lines and/or other markings or indicia found on an eyepiece of a sighting device such as a telescopic sight. Herein, a "target object" may include one or more animate and inanimate objects of various shapes and sizes. One target object may include a human type target including, but not necessarily limited to a silhouette having the general size and shape of a human being or upper body of a human being as understood by persons of ordinary skill in the art of firearm target shooting. Another target object may include an "enemy combatant" such as a human being. Another target object may include one or more animals. For reticle use, the "average center mass" (or "center mass") of a target object, including an enemy combatant, suitably includes a designated width according of the target object, e.g., the outer shoulder tip to outer shoulder tip (or "shoulder tip to shoulder tip") width of an enemy combatant when directly facing the reticle or when turned 180.0 degrees facing directly away from the reticle (herein referred to as a "primary firing position"). The term "dot" is used to define an indicator of the location of generic aiming points on the reticle. The term "dot" may employ any shape as desired and need not necessarily be provided in substantially circular form. Herein "mph" stands for miles per hour and "mps" refers to meters per second. Herein "km/h" stands for kilometers per hour. The phrase "time on target" refers to the time required for visual target acquisition, i.e., the time required for a firearm shooter to realize the aiming point of a given round to a particular target in real time. Herein, the phrase "variable target" refers to a target object that is changeable in height and/or width. Herein, the "full height" of a target object such as an enemy combatant is a measurement from the top of the head to the bottom of the feet. For purposes of this application, the phrase "correction of fire" means adjusting the point of aim to the point of impact. Herein, the phrase "weapon system" refers to a firearm and its various components used for purposes of targeting and firing one or more rounds.

As understood by persons of ordinary skill in the art of firearm shooting, "MOA" means Minutes of Angle. Likewise, "MIL" is a shortening of the term milliradian. As also understood by the skilled artisan, "5.56" and "5.56 round" refer to the 5.56×45 mm NATO (military designation) cartridge or round. Likewise, ".223" and ".223 round" refer to the .223 Remington cartridge or round. As understood by the skilled artisan, the .223 round is used in a variety of rifles including, but not necessarily limited to AR15-type rifle platforms. As also understood by the skilled artisan, the .223 round is often referred to as a "5.56 round." Herein the phrase "bullet drop" refers to the curved trajectory traversed by a moving projectile or bullet as it falls from its initial trajectory while traveling the distance from the firearm to a target object, i.e., "range" or "target distance." As understood by the skilled artisan, bullet drop is caused by the influence of gravity on a moving projectile or bullet. Therefore, to hit a target at long range, it is necessary to elevate the barrel of the firearm and the aiming point to adjust for bullet drop. The term "full value wind" refers to wind blowing perpendicular left to right or right to left in relation to the reticle and user thereof, e.g., a cross wind. Using a clock system, full value winds travel "9 to 3" and "3 to 9" in relation to the reticle and user thereof. As understood by persons of ordinary skill in the art of firearm shooting, the term "full value" in reference to wind means that the force of the wind has a full effect on the flight of a bullet compared to a "half value wind" or "no value wind." As understood by the skilled artisan, generally, the greater the velocity of wind the greater its force.

In one aspect, the application provides a ranging reticle for firearms including indicia operationally configured to vertically and/or horizontally range a target object according to a predetermined center mass of the target object and/or predetermined height of the target object. As such, the user of the reticle can aim and fire upon a target object without having to make any calculations regarding bullet drop compensation data, wind data, moving target leading data, ranging data, fire correction data, and combinations thereof. A suitable reticle of the present application may be incorporated into a substantially flat disc or wafer formed from substantially transparent optical glass or other material suitable for manufacturing optical lenses.

In another aspect, the application provides a reticle for a projectile weapon aiming device such as a riflescope that optimizes or otherwise improves firearm shooting accuracy by allowing a user of the reticle, i.e., a firearm shooter, to take into account factors including but not necessarily limited to the height and width of a variable target object, bullet drop compensation, wind compensation and the traveling speed of a variable target object relative to what are considered by the skilled artisan as the cardinal directions.

In another aspect, a reticle is provided having pre-set parameters operationally configured to correlate one or more of range estimation information, bullet drop compensation information, wind lead information, target travel speed lead information, correction of fire or "fire correction" information, and combinations thereof. The reticle includes a central scale for (1) horizontal ranging and aiming of a variable target such as an enemy combatant oriented in a primary firing position ranging from a full height upright standing position to a prone position on the ground according to a predetermined center mass of the target and (2) adjusting for wind. The reticle is also provided with one or more separate but integrated corresponding ranging measurement side scales for vertical range estimation and aiming of a variable target oriented in one or more positions different than the primary firing position, namely, one or more secondary or alternate firing positions according to a predetermined or selected full height of the target or half height of the target, e.g., where an enemy combatant is oriented sideways relative the reticle or at least oriented less than shoulder tip to shoulder tip relative the reticle. The one or more side scales are also operationally configured to correlate vertical range estimation, target travel speed lead information and fire correction information in real time. The pre-set parameters are operationally configured to extend the accurate range of a weapon system such as a firearm by at least 100.0 percent beyond the weapon system's non-optic capacity.

In another aspect, the application provides a firearm reticle operationally configured to correlate range estimation, bullet drop compensation and travel speed of a target of a predetermined size and/or shape in windy conditions without having to make calculations to obtain information not already available according to the reticle configuration.

In another aspect, the application provides a firearm reticle operationally configured for use with one or more particular caliber firearms in relation to one or more particular target objects.

In another aspect, the application provides a firearm reticle employing bullet drop compensation ranging and aiming points over a plurality of distances, e.g., fifty (50) meter increments, wind compensation or wind adjustment marks according to one or more particular wind speeds over a plurality of distances and moving target lead marks or leads for target objects traveling at one or more predetermined speeds.

In another aspect, the application provides a firearm reticle operationally configured to provide aiming capabilities using one or more measurement scales for correction of fire to provide ranging of a desired target object.

In another aspect, the application provides a firearm reticle operationally configured to range a moving target object, e.g., enemy combatant or other animal, in real time using known parameters including, but not necessarily limited to (1) center mass of the target object according to the shoulder tip to shoulder tip width of the target object, (2) the full height of the target object, (3) the half height of the target object, (4) the traveling speed of the target object in real time, (5) the wind speed in real time, (6) fire correction, and combinations thereof.

In another aspect, the application provides a reticle for a projectile weapon aiming device such as a riflescope operationally configured for use according to a predetermined traveling speed of one or more moving target objects of a predetermined full height and/or width at a given distance from the firearm reticle.

In another aspect, the application provides a firearm reticle whereby a user may employ one or more target acquisition features of the reticle as desired.

In another aspect, the application provides a firearm reticle whereby a user may employ one or more target acquisition features of the reticle without the need to make any calculations prior to firing one or more rounds at one or more target objects using a firearm corresponding to the reticle.

In another aspect, the application provides a method of ranging a target object by providing a firearm reticle on an optical instrument, the firearm reticle including a central scale displaying bullet trajectory over known distances from the firearm reticle including target object shoulder tip to shoulder tip width indicators at known distances. The firearm reticle includes secondary scales to promote optimum target acquisition when the shoulder tip to shoulder tip width of a target object is unattainable or otherwise obstructed from view of the user of the firearm reticle.

In another aspect, the application provides a firearm reticle employing bullet drop compensation aiming points over a plurality of distances, wind compensation according to one or more wind speeds realized over a plurality of distances and moving target lead marks for target objects traveling at one or more predetermined speeds in real time. As to aiming capabilities in regard to an enemy combatant, the firearm reticle is operationally configured to provide shoulder tip to shoulder tip horizontal ranging of an enemy combatant at a base distance and correlate bullet drop compensation according to shoulder tip to shoulder tip horizontal range estimation of the enemy combatant at one or more incremental distances from the firearm reticle greater than the base distance. Shoulder tip to shoulder tip horizontal ranging of an enemy combatant may be accomplished with an enemy combatant in oriented in a standing position, seated position, kneeling position and prone position. The reticle is also operationally configured to vertically range an enemy combatant in standing position, seated position and kneeling position. The reticle is also operationally configured to vertically range an enemy combatant that is partially obstructed from view, e.g., an enemy combatant standing behind a shrub, bush, rock, fence or other object that rises up to about the waist area of the enemy combatant.

In another aspect, the application provides a method for extending the range of a particular weapon system by providing a firearm reticle operationally configured with pre-calculated parameters regarding wind speed, the speed of a variable target object in motion, bullet drop compensation, horizontal ranging information, vertical ranging information, fire correction, and combinations thereof.

In another aspect, the present application is directed to a firearm reticle including indicia operationally configured to correlate one or more of range estimation, bullet drop compensation, horizontal range estimation, vertical range estimation, wind adjustment information, target travel speed lead information, correction of fire, and combinations thereof for one or more target objects in a calculation free manner. The firearm reticle is operationally configured to range a target object at a base distance and one or more incremental distances beyond the base distance. The firearm reticle includes a plurality of measurement marks including at least one measurement mark operationally configured to provide multiple ranging information. Because wind may offset a desired path of a projectile such as a bullet, the firearm reticle may also include one or more wind adjustment marks to allow for aiming adjustments in windy conditions.

In another aspect, the present application is directed to a firearm reticle for acquisition of a variable target object, the firearm reticle having one or more pre-set parameters selected from the group consisting of horizontal range estimation, vertical range estimation, bullet drop compensation, wind adjustment information, target travel speed lead information, fire correction information, and combinations thereof according to a particular firearm package.

In another aspect, the present application is directed to a reticle and method of using the reticle having advantages not taught by the prior art. For example, the present application is directed to a calculation free method of decreasing time on target for a user of a firearm including providing a firearm reticle for use with a firearm of a particular package, the firearm reticle having a central scale and one or more side scale with pre-set parameters selected from the group consisting of horizontal range estimation, vertical range estimation, bullet drop compensation, wind adjustment information, target travel speed lead information, fire correction information, and combinations thereof according to a particular firearm package.

In another aspect, the present application is directed to a reticle that may be configured to include 50.0 meter incremental bullet drop compensation crosshairs or marks providing aiming points out to 800.0 meters. In another embodiment, reticle that may be configured to include 50.0 meter incremental bullet drop compensation crosshairs or marks providing aiming points out to 1000.0 meters.

In another aspect, the present application is directed to a reticle that may be configured to include integrated moving target lead marks for speeds up to 64.4 km/h (40.0 mph).

In another aspect, the present application is directed to a reticle that may be configured to include full value wind holds ("wind adjustment marks") for winds ranging from 1.12 mps (2.5 mph) to 4.5 mps (10.0 mph) at distances from 400.0 meters to 800.0 meters.

In another aspect, the present application is directed to a reticle providing automatic horizontal and vertical target ranging and bullet drop compensation without the need to make any calculations by providing a combination of vertical lines, horizontal lines, and dots in combination with a primary ranging mark in a form including, but not necessarily limited to a chevron, a closed circle, a full circle, an inverted "T" shape, an "X" shape, a solid dot, a rectangle, and triangle.

In another aspect, the present application is directed to a reticle having a feature-rich and intuitive design that is uncluttered in a manner effective to communicate various types of information to a user in an efficient manner to (1) increase first-hit probability of a target object and (2) reduce the time necessary to reach a firing solution to achieve a hit on a target object compared to prior art reticles.

In another aspect, the present application is directed to a reticle operationally configured for use as part of one or more commercially available optical gunsights. One exemplary commercially available optical gunsight that may incorporate the reticle of this application includes the Trijicon ACOG® Advanced Combat Optical Gunsight commercially available from Trijicon, Inc., Wixom, Mich., U.S.A.

Figure 2:
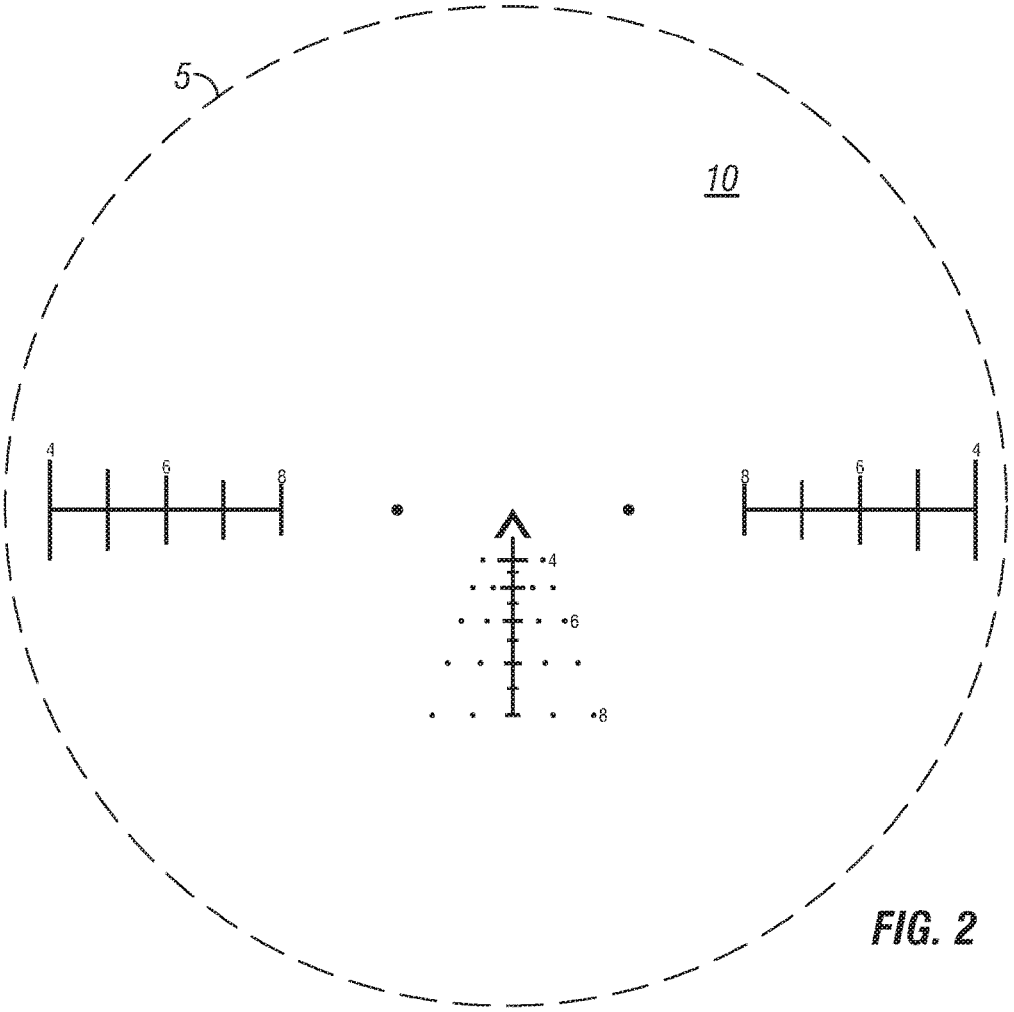
FIG. 2 is another plan view of the reticle of FIG. 1.

With reference to FIG. 1, a first embodiment of a firearm reticle 10 (hereafter "reticle 10") of the present application is provided. When viewed through a telescopic sight (or "scope"), the reticle 10 may appear as shown in FIG. 2, which includes the reticle 10 set within a demonstrative sight picture 5. As understood by the skilled artisan, the size of the reticle 10 in relation to its corresponding demonstrative sight picture 5 may vary.

Figure 3:
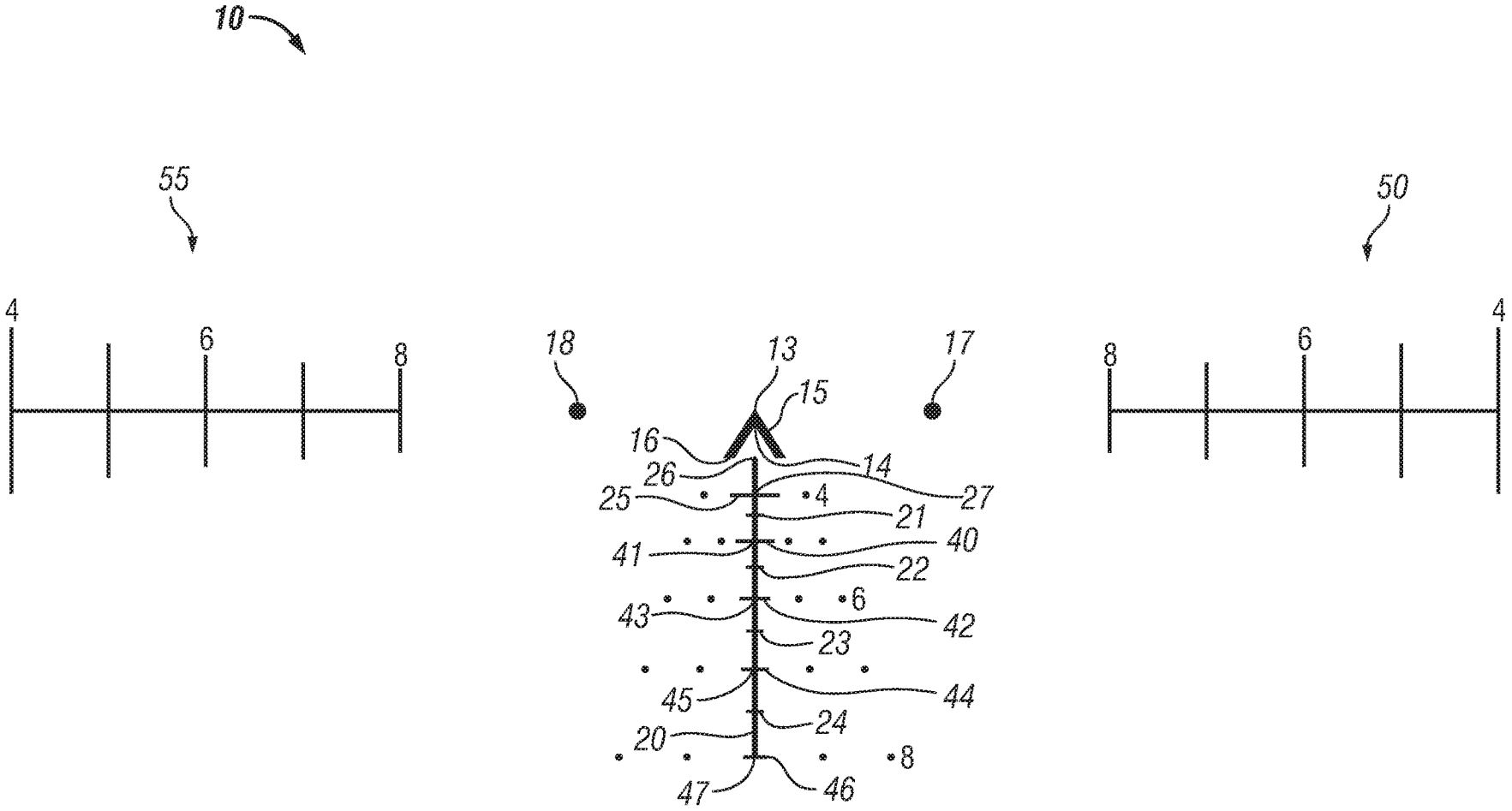
FIG. 3 is another plan view of the reticle of FIG. 1.

Although the reticle 10 may be calibrated for a plurality of cartridges and platforms, for purposes of this application, the reticle 10 described herein is calibrated for 5.56 (.223 caliber) rifles from 300.0 meters to 800.0 meters. Turning to FIG. 3, the reticle 10 is defined by indicia or indicators effective as aiming marks. In particular, the reticle 10 may include at least (1) a first measurement mark or primary measurement mark (hereafter referred to as "central aiming marker 15"), (2) a second measurement mark in the form of a central vertical line or post referred to herein as a "central vertical crosshair 20" and at least a first horizontal line or "horizontal crosshair 25" intersecting the central vertical crosshair 20, and (3) a third measurement mark in the form of a first side scale 50 positioned to the right of the central aiming marker 15. As discussed below, the reticle 10 may also include one or more wind adjustment marks, one or more lead marks, and a fourth measurement mark in the form of a second side scale 55 positioned to the left of the central aiming marker 15. As shown, the central vertical crosshair 20, first side scale 50 and second side scale 55 are each disposed radially from central aiming marker 15.

Operation of the reticle 10 is suitably determined according to the set spacing and sizes of the individual indicia or indicators described herein relative to each other. Depending on the characteristics of a particular firearm utilizing the reticle 10, the reticle 10 may be set to range a target object at one or more particular distances as desired. In addition, the reticle 10 employs basic perspective principles known in the field of ranging reticles. For example, a target object appears smaller to an individual the further that the target object is from the individual using the reticle 10.

Although the reticle 10 of this application may be operationally configured as desired, the reticle 10 will be discussed herein in terms of a first measurement mark or central aiming marker 15 operationally configured for initial horizontal ranging and target acquisition at a base distance of 300.0 meters based on a predetermined average center mass of an enemy combatant 99 of 0.48 meters (19.0 inches), i.e., the "selected center mass" or "selected width." In another embodiment, the selected center mass of an enemy combatant 99 may be set at 0.46 meters (18.0 inches). Suitably, the selected center mass may vary according to one or more intended target objects. In addition, vertical targeting of an enemy combatant 99 in relation to the reticle 10 is discussed in terms of a predetermined full height of an enemy combatant 99 of or about 1.70 meters (67.0 inches), hereafter referred to as the "selected full height" or "selected height," which describes an individual commonly referred to in the United States of America as being five feet seven inches tall. Other predetermined selected heights may be employed as desired according to one or more particular target objects.

When viewed through a scope of a firearm, the free standing central aiming marker 15 may be centrally located according to a sight picture 5 as shown in FIG. 2. As depicted in FIGS. 1-3, the central aiming marker 15 may be provided as a chevron as shown operationally configured for initial target acquisition correlating to a size requirement of one or more particular target objects at a predetermined or selected distance from a reticle 10. As shown, the chevron is provided with the closed-end oriented at the top. In another embodiment, the chevron may be inverted with the closed-end oriented at the bottom. The central aiming marker 15 may also be provided in other forms or shapes other than a chevron. For example, the central aiming marker 15 may have a particular shape operationally configured to equip the reticle 10 for aiming at a particular target object, including animate and inanimate objects of various shapes and sizes. Exemplary alternate shapes of the central aiming marker 15 include, but are not necessarily limited to open circles, cross-hairs ("X" and "+" shapes), open spacing of parallel horizontal lines and any other shape effective for horizontal range estimation and target aiming.

Figure 4:
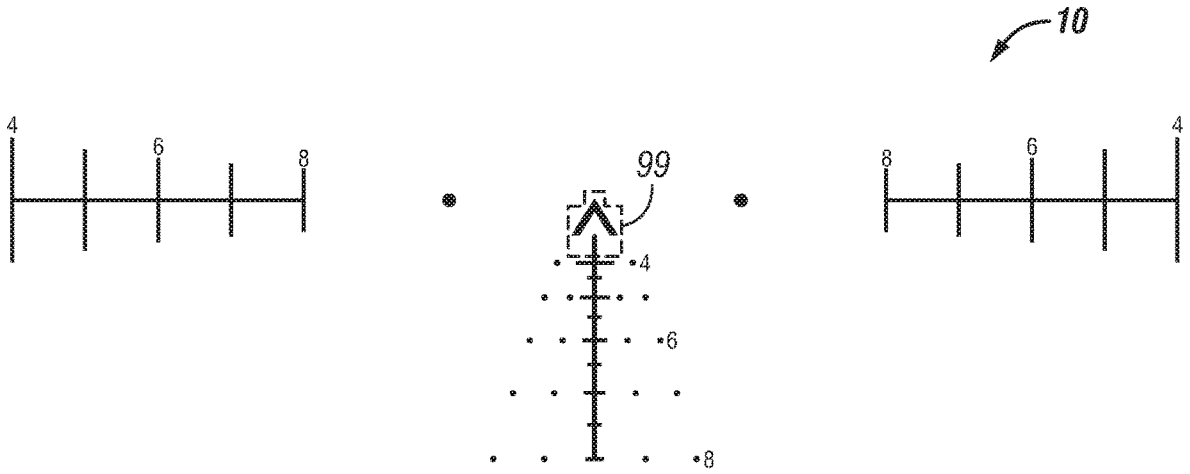
FIG. 4 is another plan view of the reticle of FIG. 1.

In FIG. 3, the chevron type central aiming marker 15 is suitably operationally configured for initial target acquisition of an enemy combatant 99 by way of horizontal range estimation of the enemy combatant 99 at a base distance of 300.0 meters based on the center mass of 0.48 meters (19.0 inches). Accordingly, the width of the chevron type central aiming marker 15 at its base 16 is 5.53 MOA, corresponds to a center mass of 0.48 meters (19.0 inches) at 300.0 meters. At a distance of 300.0 meters, suitable horizontal ranging of an enemy combatant 99 is accomplished using the width of the base 16 of the central aiming marker 15 to range estimate an enemy combatant 99 shoulder tip to shoulder tip as shown in the simplified illustration of FIG. 4. In operation, once an enemy combatant 99 is ranged shoulder tip to shoulder tip at a base distance of 300.0 meters, the uppermost end 26 of the central vertical crosshair 20 (see FIG. 3) may be used as a target aiming point or point of impact on an enemy combatant 99 for shots fired at 300.0 meters. For shots fired at 100.0 meters, the uppermost part 13 (or "outer tip 13") of the central aiming marker 15 may be used to provide a target aiming point or point of impact on an enemy combatant 99. For shots fired at 200.0 meters, the inner corner 14 of the chevron central aiming marker 15 may be used to provide a target aiming point or point of impact on an enemy combatant 99.

As stated above, the reticle 10 is suitably operationally configured to correlate bullet drop compensation with shoulder tip to shoulder tip horizontal range estimation of an enemy combatant 99 at one or more incremental distances greater than the base distance. For firearm distance shooting as often employed by weekend enthusiasts, competition shooters, hunters, law enforcement officers and military snipers, it is important to consider the drop of a bullet over distance. As understood by the skilled artisan, the amount of bullet drop may be determined according to one or more factors including, but not necessarily limited to bullet caliber, barrel length, rifling, bullet weight, charge of ammunition, and combinations thereof. Such factors are often referred to by persons of ordinary skill in the art of firearms and shooting as a "package" and are substantially uniform over time for a particular firearm. Thus, as a target object lies further away from a particular reticle 10, the various indicia or indicators of the reticle 10 provided may be oriented and sized for ranging an enemy combatant 99 based on a given package. As such, the present reticle 10 may include at least (1) a second measurement mark in the form of a central vertical line or central vertical crosshair 20 extending downward from a midpoint (left to right) of the central aiming marker 15 and a first horizontal line or first horizontal crosshair 25 intersecting the central vertical crosshair 20 at a first intersection point 27. Suitably, the width of the first horizontal crosshair 25 correlates to the center mass of an enemy combatant 99 at a first predetermined incremental distance greater than the base distance. As such, the first horizontal crosshair 25 may be referred to herein as a "secondary ranging indicator" or a "first secondary ranging indicator" in an embodiment of the reticle 10 including a plurality of horizontal crosshairs that intersect the central vertical crosshair 20 for horizontal ranging and for locating an appropriate target aiming point as discussed below. Herein, each of the horizontal crosshairs may also be referred to as "marks," "ranging marks," "horizontal ranging marks" or "bullet drop compensation marks."

In this embodiment of the reticle 10, the first incremental distance corresponding to the first horizontal crosshair 25 is a distance of 400.0 meters. In operation, once an enemy combatant 99 is ranged shoulder tip to shoulder tip at 400.0 meters according to the width of the first horizontal crosshair 25, the first intersection point 27 is operationally configured as a target aiming point or point of impact on the enemy combatant 99 for shots fired at 400.0 meters (see FIG. 5). In a scenario where wind is not a factor to be considered, the range estimation and the targeting of an enemy combatant 99 may be correlated along the length of the central vertical crosshair 20 without having to move to a different aiming point as discussed below.

With further reference to FIG. 3, the reticle 10 may also include one or more additional horizontal crosshairs 40, 42, 44, 46, i.e., additional secondary ranging indicators, intersecting the central vertical crosshair 20 in series at one or more points to provide a scale for horizontal ranging and targeting of an enemy combatant 99 shoulder tip to shoulder tip at one or more predetermined incremental distances from the reticle 10 greater than 400.0 meters. Herein, the secondary ranging indicators 25, 40, 42, 44, 46 may collectively be referred as "primary horizontal crosshairs" disposed along the central vertical crosshair 20.

In this embodiment, the reticle 10 includes at least a second horizontal line or second horizontal crosshair 40 intersecting the central vertical crosshair 20 at a second intersection point 41 defining a second incremental distance beyond the base distance. Suitably, the second horizontal crosshair 40 has a width that correlates to the center mass of an enemy combatant 99 at the second incremental distance greater than the base distance whereby the second intersection point 41 provides a target aiming point or point of impact for shots fired at such distance. In this embodiment, the second incremental distance is provided as 500.0 meters. In other words, once an enemy combatant 99 is ranged at 500.0 meters via the second horizontal crosshair 40, the second intersection point 41 may be used to provide a target aiming point or point of impact on an enemy combatant 99 for shots fired at 500.0 meters as shown in FIG. 6.

Figure 5:
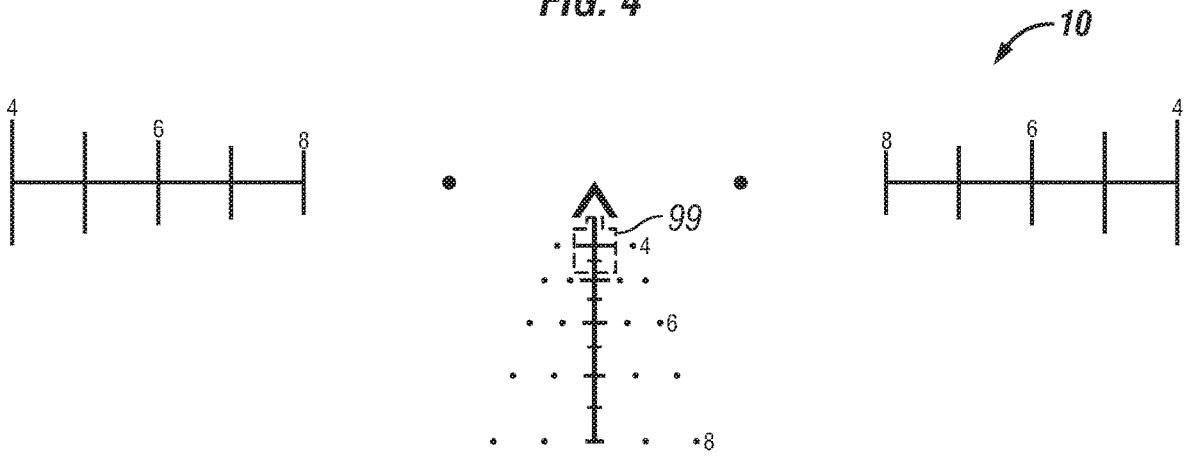
FIG. 5 is another plan view of the reticle of FIG. 1.
Figure 6:
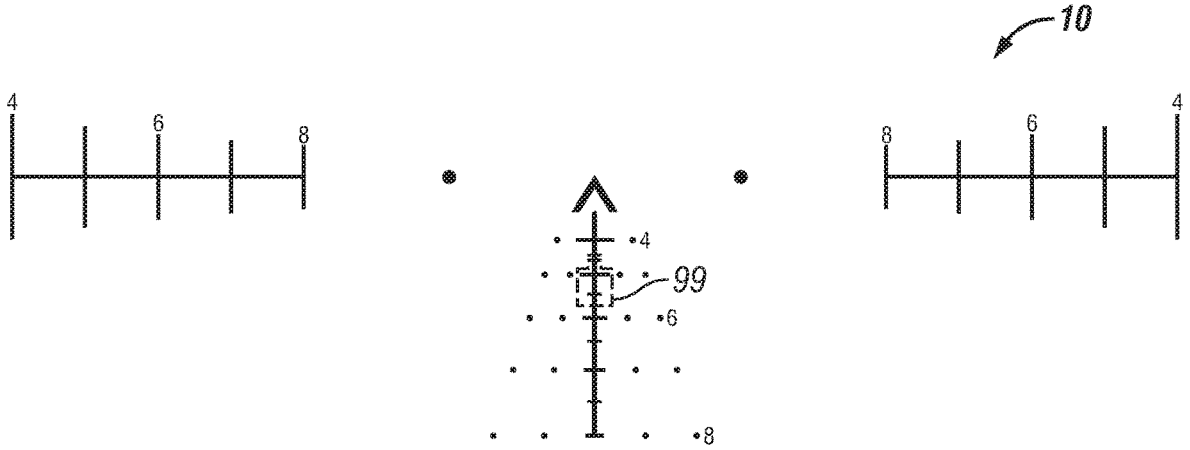
FIG. 6 is another plan view of the reticle of FIG. 1.

With further reference to FIG. 3, additional horizontal crosshairs may be provided for horizontal ranging and aiming of an enemy combatant 99 at 600.0 meters (see crosshair 42 and intersection point 43), 700.0 meters (see crosshair 44 and intersection point 45) and 800.0 meters (see crosshair 46 and intersection point 47) in a similar fashion as described in reference to FIGS. 5 and 6. As can also be seen in FIG. 3, each succeeding horizontal crosshair in series is narrower left to right, i.e., decreasing in width, corresponding to the shoulder tip to shoulder tip ranging of an enemy combatant 99 at increasing distances apart from the reticle 10. Herein, the central aiming marker 15, the central vertical crosshair 20 and the one or more horizontal crosshairs 25, 40, 42, 44, 46 intersecting the central vertical crosshair 20 may collectively be referred to as a "central scale" of the reticle 10. In this embodiment of the reticle 10, the central scale provides for horizontal ranging of an enemy combatant 99 that is directly facing the user of a firearm and related reticle 10, or directly facing 180.0 degrees in the opposite direction, for shoulder tip to shoulder tip ranging. Shoulder tip to shoulder tip ranging may be accomplished (1) when the enemy combatant 99 is standing upright at a full height of the enemy combatant 99, (2) when the enemy combatant 99 is kneeling on one or two knees, (3) when the enemy combatant 99 is situated in a seated position, and (4) when the enemy combatant 99 is in a prone position.

With further reference to FIG. 3, the intersection point 47 of crosshair 46 suitably defines the bottom or terminal end of the central vertical crosshair 20. In another embodiment, the terminal end of the central vertical crosshair 20 may be located at a different point on the reticle 10, e.g., the central vertical crosshair 20 may terminate at a distance for horizontal ranging of an enemy combatant 99 at a distance from the reticle 10 less than or greater than 800.0 meters. As stated above, the reticle 10 may require different bullet drop compensation calibrations for different cartridges and platforms. This is because there are many factors that determine a projectile or bullet's flight path through space. For example, (1) muzzle velocity, (2) bullet type and (3) altitude may affect how quickly a bullet drops as it flies downrange through space. As such, it is herein contemplated that the reticle 10 may employ bullet drop compensation ranging for distances from the reticle 10 different from the distances described above in relation to FIG. 3. In one simplified example, the reticle 10 may employ bullet drop compensation ranging for distances from 100.0 meters to 500.0 meters. In another simplified example, the reticle 10 may employ bullet drop compensation ranging for distances from 200.0 meters to 800.0 meters. In still another embodiment, the reticle 10 may obtain ranges in yards rather than meters. For example, a reticle 10 as shown in FIG. 1 may be operationally configured to range from 300.0 yards to 800.0 yards. The range of bullet drop compensation and the unit of measure employed for a particular reticle 10 are not limited and the above distances are provided as examples.

As further shown in FIG. 3, the central scale may also include one or more additional horizontal crosshairs 21-24 (herein referred to as "secondary horizontal crosshairs") intersecting the vertical crosshair 20 between each of the primary horizontal crosshairs 25, 40, 42, 44 and 46 as shown. For purposes of this application, the secondary horizontal crosshairs 21-24 may be provided for bullet drop compensation purposes. In the embodiment of FIG. 3, each of the secondary horizontal crosshairs 21-24 correlates to a fifty meter (50.0 meter) bullet drop in relation to adjacent primary horizontal crosshairs 25, 40, 42, 44 and 46. In another embodiment of the reticle 10, the bullet drop compensation of the secondary horizontal crosshairs 21-24 may vary from 50.0 meters.

The points of intersection of the primary and secondary horizontal crosshairs along the vertical crosshair 20 suitably provide target aiming points or points of impact on an enemy combatant 99 for shots fired at various distances according to the points of intersection, unless there is wind, whereby the reticle 10 may further include one or more wind adjustment marks to allow for aiming adjustments in windy conditions. As shown in FIG. 3, the distance between the primary horizontal crosshairs 25, 40, 42, 44 and 46 progressively increases below the central aiming marker 15 according to the increased bullet drop realized over increasing distances from the reticle 10, i.e., the distance between horizontal crosshairs 44 and 46 is greater than the distance between horizontal crosshairs 40 and 42. Likewise, the distance between the secondary horizontal crosshairs 21-24 progressively increases below the central aiming marker 15 according to the increased bullet drop realized over increasing distances from the reticle 10.

As discussed below, one or more of the primary and/or secondary horizontal crosshairs may be operationally configured as a wind adjustment mark. Likewise, additional wind adjustment marks may be included on either side of the primary and/or secondary horizontal crosshairs as desired or as otherwise required for maximum use and efficiency of the reticle 10.

Figure 7:
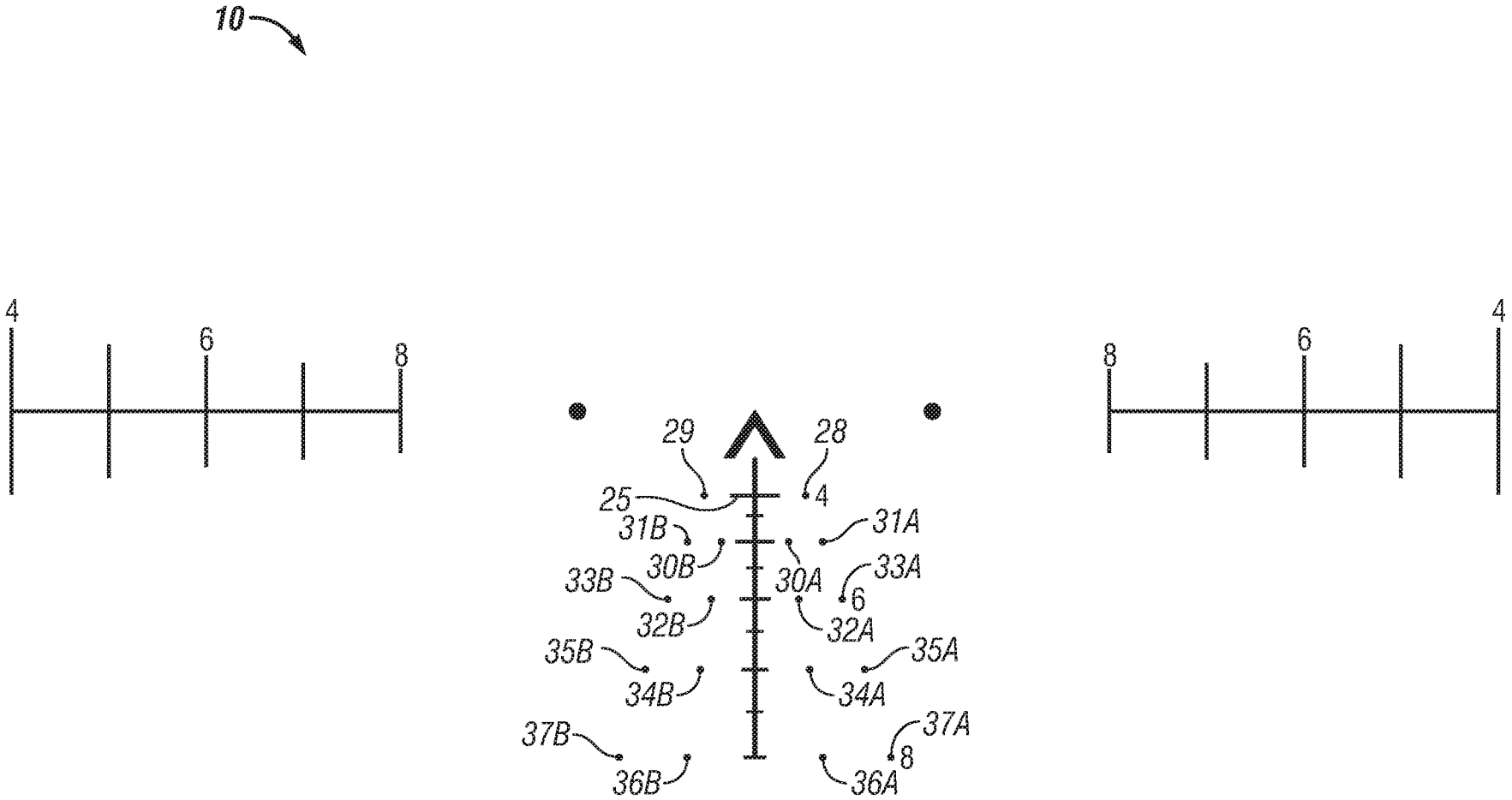
FIG. 7 is another plan view of the reticle of FIG. 1.

Referring to FIG. 7, additional wind adjustment marks may be provided as mirror-image indicia in the form of solid dots set in horizontal alignment with corresponding horizontal crosshairs and spaced apart to correlate to a predetermined wind speed. Herein, such wind adjustment marks may be referred to as "full value wind holds" as such is understood by the skilled artisan. For example, the first horizontal crosshair 25 of this embodiment of the reticle 10 is provided with a set of wind adjustment marks 28, 29 (hereafter "wind adjustment dots") on opposite sides of the first horizontal crosshair 25 at a distance effective to compensate for an average cross wind speed of or about 4.5 mps (10.0 mph). In this embodiment, the first horizontal crosshair 25 itself may also be used for purposes of wind adjustment. In other words, not only does the first horizontal crosshair 25 have a width operationally configured to range the center mass of an enemy combatant 99 shoulder tip to shoulder tip at 400.0 meters, but the left and right edges of the first horizontal crosshair 25 are operationally configured to compensate for an average cross wind speed of or about 2.2 mps (5.0 mph). As such, at least a first horizontal crosshair 25 is operationally configured to range distance and adjust for wind in real time without the need to make any calculations. In this embodiment, the central aiming marker 15 does not include any wind adjustment marks. However, in another embodiment of the reticle 10, one or more wind adjustment marks may be located on either side of the central aiming mark 15.

It is further contemplated that the right and left edges of the remaining horizontal crosshairs may also be used for adjusting for wind. However, in regard to each of the remaining primary horizontal crosshairs 40, 42, 44 and 46, wind adjustment is suitably accomplished via the inclusion of two sets of wind adjustment dots positioned on opposite sides of the crosshairs 40, 42, 44 and 46 at distances effective to provide uniform wind adjustment settings to compensate for an average cross wind velocity or speed of 2.2 mps (5.0 mph) and 4.5 mps (10.0 mph). For example, horizontal crosshair 40, which is effective for ranging and aiming at an enemy combatant 99 at 500.0 meters is provided with a first set of wind adjustment dots 30A, 30B on opposite sides of the horizontal crosshair 40 effective to compensate for an average cross wind velocity or speed of 2.2 mps (5.0 mph). The horizontal crosshair 40 also includes a second set of wind adjustment dots 31A, 31B on opposite sides of the horizontal crosshair 40 effective to compensate for an average cross wind velocity or speed of 4.5 mps (10.0 mph). In this embodiment, wind adjustment may also be accomplished for an average cross wind velocity or speed of 3.4 mps (7.5 mph) by locating a target object halfway between wind adjustment dots 30A and 31A or 30B and 31B depending on the direction of the wind. In this embodiment, wind adjustment may also be accomplished for an average cross wind velocity or speed of 1.11 mps (2.5 mph) by locating a target object halfway between wind adjustment dot 30A and the right side edge of horizontal crosshair 40 or wind adjustment dot 30B and the left side edge of horizontal crosshair 40 depending on the direction of the wind.

Additional sets of wind adjustment dots may be included to account for greater wind speeds and/or lesser wind speeds as desired. As understood by the skilled artisan, each set of additional wind adjustment dots compensating for increasing wind speeds will be located further from the central vertical crosshair 20 compared to sets of wind adjustment dots compensating for lesser wind speeds.

As further depicted in FIG. 7, each of the remaining primary horizontal crosshairs 42, 44 and 46 may also include two sets of wind adjustment dots including an inner set of dots effective to compensate for an average cross wind velocity or speed of about 2.2 mps (5.0 mph) and an outer set of dots effective to compensate for an average cross wind velocity or speed of about 4.5 mps (10.0 mph) similar as describe above (see wind adjustment dots 32A-37A and 32B-37B). As depicted, the various sets of wind adjustment dots are set increasingly further apart from their corresponding intersections 43, 45, and 47, the greater the distance that a user is horizontally ranging an enemy combatant 99 beyond the base distance. As understood by the skilled artisan, the wind adjustment dots that are located to the right of the central vertical crosshair 20 (e.g., 28, 30A, 31A, etc.) are used for aiming in the presence of a right to left cross wind. Likewise, the wind adjustment dots that are located to the left of the central vertical crosshair 20 (e.g., 29, 30B, 31B, etc.) are used for aiming in the presence of a left to right cross wind. In addition, even though the wind adjustment marks are shown as solid dots, the wind adjustment marks may be provided in one or more different or additional forms including, but not necessarily limited to closed circles, partially open circles, chevron tips, crosshairs, open ended crosshairs, horizontal lines, and combinations thereof.

In a scenario where a target object such as an enemy combatant 99 is moving or traveling left to right or right to left, the reticle 10 suitably includes one or more lead marks operationally configured to assist with maximizing aiming capabilities of the reticle 10 in regard to an enemy combatant 99 that may be in the act of walking, jogging, running or moving at even a faster pace, e.g., riding in a vehicle, left to right or right to left. For example, the central aiming marker 15 is not only operationally configured for horizontal range estimation and target aiming, the central aiming marker 15 is also operationally configured to adjust for a moving target object that is moving or traveling left to right or right to left at a distance apart from the reticle 10 of 100.0-300.0 meters without the need to make any calculations. Referring to FIG. 3, in a scenario where an enemy combatant 99 is walking left to right at a distance apart from the reticle 10 of 100.0-300.0 meters, the left edge of the base 16 of the central aiming marker 15 may be used as a lead aiming point on the enemy combatant 99, which correlates to an enemy combatant 99 walking at 4.98 km/h (3.1 miles per hour) while carrying a military type weapon such as a rifle. Likewise, the right edge of the base 16 may be used as a lead aiming point on an enemy combatant 99 that is walking right to left at 4.98 km/h (3.1 miles per hour).

With further reference to FIG. 3, the reticle 10 may also include a first set of free standing lead marks 17, 18 (or "leads 17, 18") provided as mirror-image indicia with their centers set in horizontal alignment with the uppermost part 13 of the central aiming marker 15 on opposite sides as shown for efficiency in aiming at a moving enemy combatant 99 that is traveling at a pace faster than walking, e.g., jogging or running, right to left or left to right while carrying a military type weapon. The location of the leads 17, 18 in relation to the uppermost part 13 of the central aiming marker 15 correlate to an enemy combatant 99 running at 13.8 km/h (8.6 mph). In one simplified example, where a target object such as an enemy combatant 99 is running left to right at a distance apart from the reticle 10 of 100.0-300.0 meters the left side lead 18 may be aimed at the enemy combatant 99 rather than the central aiming marker 15. In another embodiment, the leads 17, 18 may be set apart from the uppermost part 13 of the central aiming marker 15 a distance that correlates to a different estimated travel speed of an enemy combatant 99.

It is also contemplated that in another embodiment, one or more additional lead marks may be employed that correlate to one or more different target speeds. As understood by persons of ordinary skill in the art, faster moving targets require a greater lead than slower moving targets and vice versa. As such, one or more additional sets of lead marks may be set apart from the central aiming marker 15 at distances correlating for speeds greater than or less than 13.8 km/h (8.6 mph). For example, a second set of lead marks may be located in horizontal alignment with the uppermost part 13 of the central aiming marker 15 at a second distance therefrom to correlate to an average target speed of an enemy combatant 99 of 24.1 km/h (15.0 mph). In such embodiment, the distance between the second set of lead marks, i.e., a second distance, is greater than the first distance between leads 17, 18 correlating to 13.8 km/h (8.6 mph). Although the one or more lead marks are shown as solid dots, the one or more lead marks may be provided in one or more different or additional forms including, but not necessarily limited to closed circles, open circles, chevron tips, crosshairs, open ended crosshairs, horizontal lines, and combinations thereof.

Figure 8:
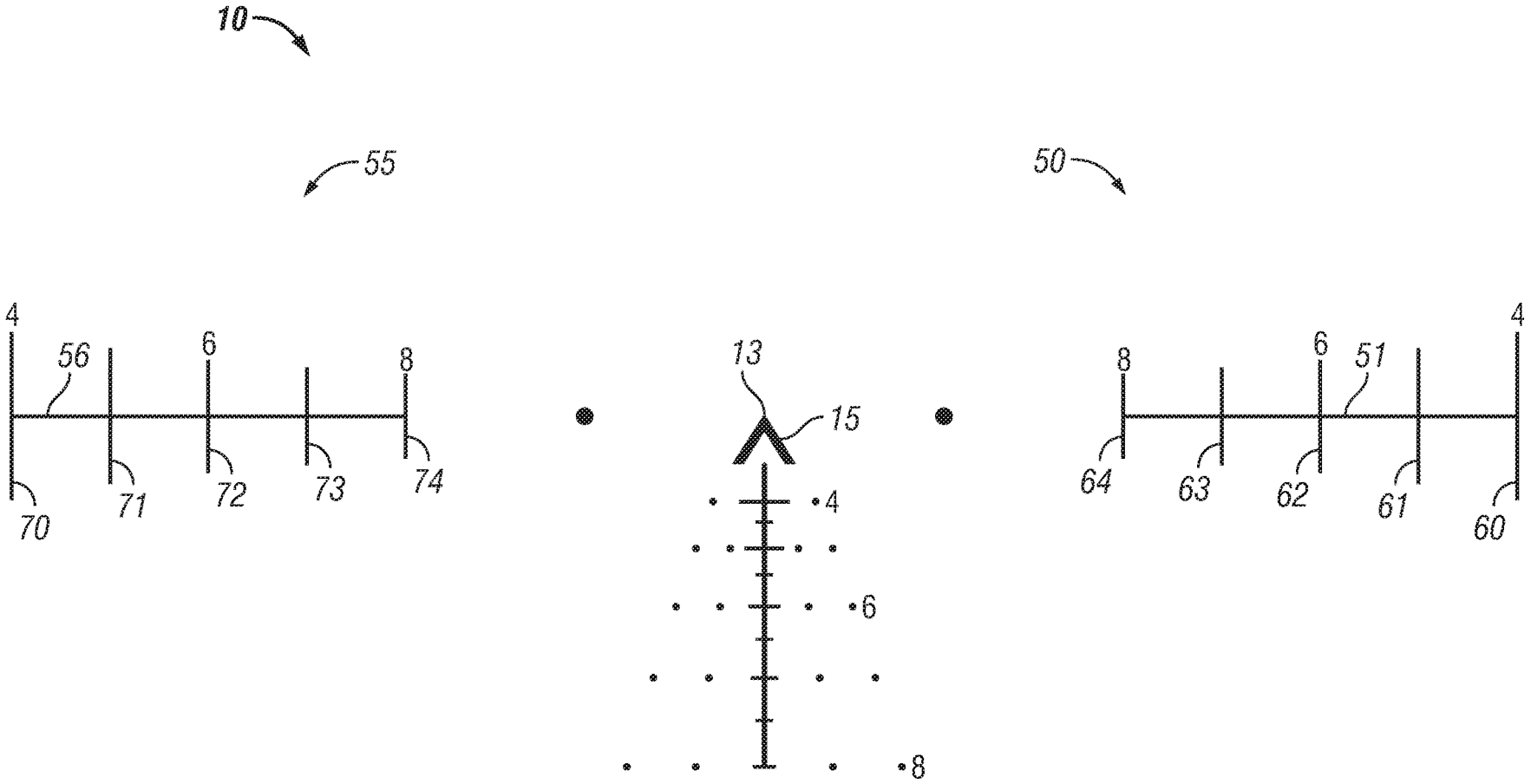
FIG. 8 is another plan view of the reticle of FIG. 1.

Referring to FIG. 8, the vertical crosshairs 60-64 and 70-74 of the first side scale 50 and second side scale 55 may also be employed as lead marks to adjust for moving target objects traveling left to right or right to left at speeds greater than those correlating to the central aiming marker 15 and leads 17, 18 discussed above. Suitably, the outermost vertical crosshairs 60, 70 of each side scale 50, 55 correlate to the fastest traveling speed to be adjusted for, with each successive inner vertical crosshair correlating to a lesser speed. For example, in one embodiment vertical crosshairs 60, 70 may correlate to 64.4 km/h (40.0 mph); vertical crosshairs 61, 71 may correlate to 56.3 km/h (35.0 mph); vertical crosshairs 62, 72 may correlate to 48.3 km/h (30.0 mph); vertical crosshairs 63, 73 may correlate to 40.2 km/h (25.0 mph); and vertical crosshairs 64, 74 may correlate to 32.2 km/h (20.0 mph).

Referring again to FIG. 7, the reticle 10 may also include distance numerals for visually indicating to a user ranging distance information for one or more particular primary horizontal crosshairs of the central scale. In this embodiment, a number "4" is located to the right of wind adjustment dot 28, whereby the number "4" represents a distance of 400.0 meters. Likewise, a number "6" is located to the right of wind adjustment dot 33A representing a distance of 600.0 meters and a number "8" is located to the right of wind adjustment dot 37A representing a distance of 800.0 meters. In another embodiment, the reticle 10 may be provided with fewer distance numerals or additional distance numerals as desired. Also, one or more distance numerals may be located on the left hand side of the central vertical crosshair 20 in addition to or in place of distance numerals located on the right hand side of the central vertical crosshair 20. Moreover, the distance numerals may be represented by actual distances. For example, the distance numeral "400" may be set adjacent wind adjustment dot 28 and/or wind adjustment dot 29 as well as adjacent the first horizontal crosshair 25 in an embodiment devoid of wind adjustment marks. However, single digit distance numerals are desirable for minimizing the surface area of indicia comprising aspects of the reticle 10, for example, to reduce cluttering of indicia, to maximize vision of objects through a scope located out beyond the indicia of the reticle 10.

Referring again to FIG. 3, the first and second side scales 50, 55 are provided as mirror-image indicia for real time vertical ranging of a target object such as an enemy combatant 99 according to a selected full height and selected half height of an enemy combatant 99. In other words, each of the first and second side scales 50, 55 may be utilized for purposes of vertical range estimation when an enemy combatant 99 is not oriented in a primary firing position and/or in instances where either the lower limbs or torso of an enemy combatant 99 are not within view or clear sight.

Referring to FIG. 8, each of the first and second side scales 50, 55 includes at least one horizontal crosshair and one or more vertical crosshairs (or "selected height indicators") intersecting the horizontal crosshair for determining the distance of an enemy combatant 99 from the reticle 10 according to (1) a selected full height of an enemy combatant 99 and/or (2) a selected half height (or "half size") of an enemy combatant 99 in a scenario where the lower limbs or torso of an enemy combatant 99 are not within view or clear sight of a user of the reticle 10. As shown, each of the first and second side scales 50, 55 suitably includes a horizontal line or horizontal crosshair 51, 56 in horizontal alignment lengthwise with the uppermost part 13 of the central aiming marker 15. Each of the first and second side scales 50, 55 may also include a plurality of selected height indicators provided as vertical crosshairs in parallel alignment that intersect the horizontal crosshairs 51, 56 at various points along the length of the horizontal crosshairs 51, 56. Suitably, the vertical crosshairs of the first and second side scales 50, 55 are operationally configured to assist a user of the reticle 10 in vertically ranging enemy combatants 99 according to a selected full height or selected half height of a target object such as an enemy combatant 99 at one or more predetermined incremental distances corresponding to the incremental bullet drop compensation distances of the primary horizontal crosshairs 25, 40, 42, 44, 46 of the central scale. In other words, the incremental distances of the vertical crosshairs of the first and second side scales 50, 55 correspond to the incremental distances of each of the primary horizontal crosshairs 25, 40, 42, 44, 46. As depicted in this embodiment, each of the first and second side scales 50, 55 suitably include five vertical crosshairs 60-64 and 70-74 of varying lengths effective for vertical range estimation of an enemy combatant 99 at distances from 400.0 to 800.0 meters. In particular, the outermost vertical crosshairs 60 and 70 are operationally configured for vertical range estimation of an enemy combatant 99 at 400.0 meters. Vertical crosshairs 61 and 71 are operationally configured for vertical range estimation of an enemy combatant 99 at 500.0 meters. Vertical crosshairs 62 and 72 are operationally configured for vertical range estimation of an enemy combatant 99 at 600.0 meters. Vertical crosshairs 63 and 73 are operationally configured for vertical range estimation of an enemy combatant 99 at 700.0 meters and vertical crosshairs 64 and 74 are operationally configured for vertical range estimation of an enemy combatant 99 at 800.0 meters. As stated above, a target object appears smaller to a viewer the further the target object is from the reticle 10. Accordingly, vertical crosshairs 60 and 70 for ranging an enemy combatant 99 at 400.0 meters are greater in length than vertical crosshairs 61 and 71 for ranging an enemy combatant 99 at 500.0 meters and so forth.

Figure 9:
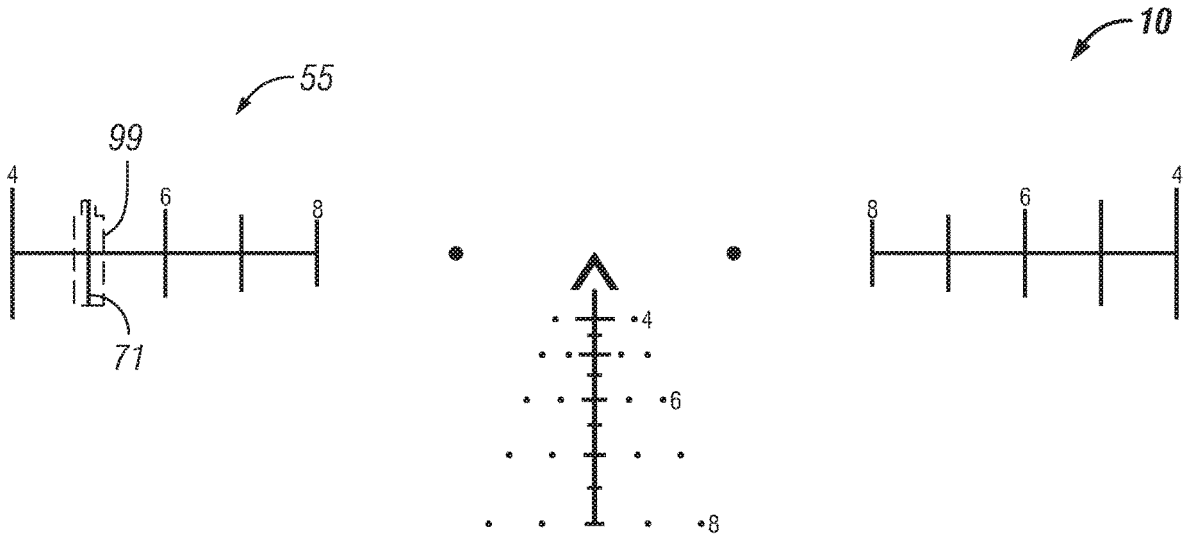
FIG. 9 is another plan view of the reticle of FIG. 1.

In this embodiment, the full length of each of the vertical crosshairs 60-64 and 70-74 is effective for ranging the full height of an enemy combatant 99 at each of the predetermined distances from 400.0 meters to 800.0 meters by visually locating an enemy combatant 99 along one of the horizontal crosshairs 51, 56 until the height of the enemy combatant 99 is equal to or substantially equal to the height or length of a particular vertical crosshair. As shown in the simplified example of FIG. 9, a user may range an enemy combatant 99 using the second side scale 55 by visually locating the enemy combatant 99 with the vertical crosshair most similar in height as the enemy combatant 99, which in this example is vertical crosshair 71, effective for ranging an enemy combatant 99 at 500.0 meters. Such range estimation of an enemy combatant 99 via the first or second side scales 50, 55 provides real time distance to target information for an enemy combatant 99 in a calculation free manner.

As stated above, vertical range estimation using the vertical crosshairs 60-64 and 70-74 is effective in a scenario where a target object such as an enemy combatant 99 is not oriented in a primary firing position and/or in instances where either the lower limbs or torso of an enemy combatant 99 are not within view or clear sight. However, the first and second side scales 50, 55 may also be used to vertically range an enemy combatant 99 in addition to horizontal ranging via the central scale for purposes of enhancement of shooting accuracy. As understood by the skilled artisan, when using the naked eye for shooting, typically the larger the target object the better the accuracy. As such, as an initial step in aiming at an enemy combatant 99 the full height of the enemy combatant 99 may first be ranged using either the first side scale 50 or second side scale 55 prior to taking aim according to a determined intersection point along the central scale.

Figure 10:
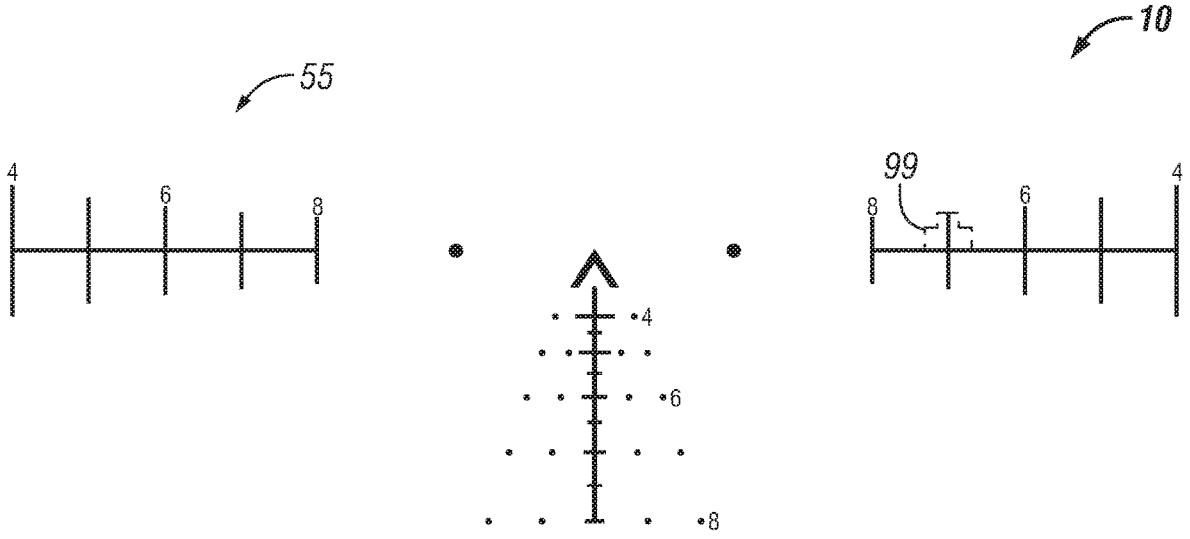
FIG. 10 is another plan view of the reticle of FIG. 1.
Figure 11:
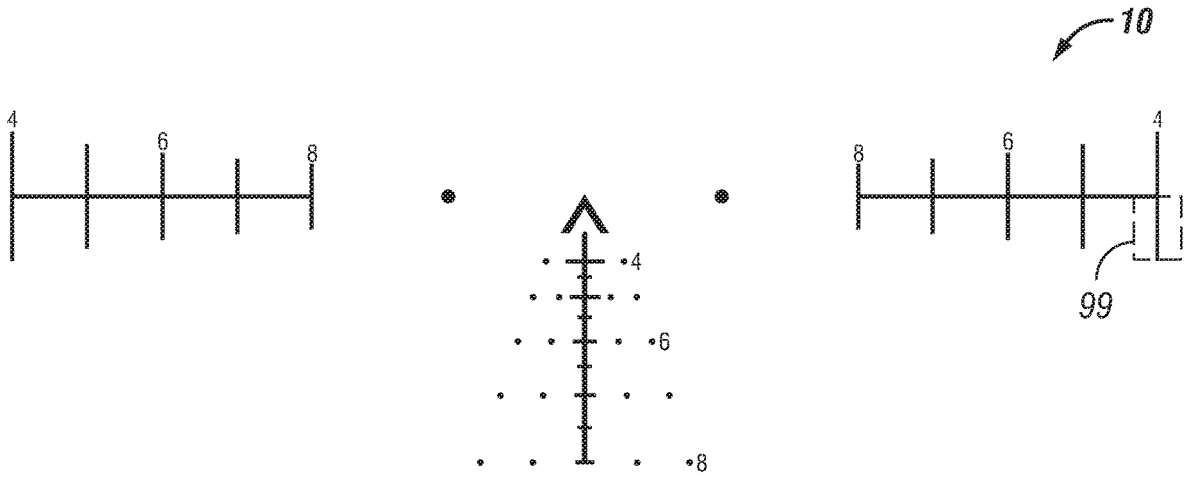
FIG. 11 is another plan view of the reticle of FIG. 1.

As further depicted in FIG. 8, the horizontal crosshairs 51 and 56 intersect the vertical crosshairs 60-64, 70-74 perpendicularly providing upper and lower line segments of equal length above and below the horizontal crosshairs 51 and 56 as shown. For purposes of this application, the length of each individual upper and lower line segment corresponds to a selected half height of an enemy combatant 99 at a predetermined distance. Accordingly, in a scenario where the full height of an enemy combatant 99 cannot be ranged either because the lower limbs or torso of an enemy combatant 99 are not within view or clear sight to the user of the reticle 10, e.g., where an enemy combatant 99 drops to one knee, the height of the enemy combatant 99 may nevertheless be ranged by matching half or about half the height of an enemy combatant 99 with the most identical upper or lower line segment to determine the distance to target of the enemy combatant 99. Herein, for vertical range estimation of a selected half height of an enemy combatant 99, the midpoint of a target individual is suitably located at or near the bottom of the pelvis of the target individual, i.e., the region of the body where the legs join the torso commonly referred to as the crotch. Thus, the upper half of an enemy combatant 99 may be ranged from the midpoint to the top of the head as shown in FIG. 10 and the lower half of an enemy combatant 99 may be ranged from the midpoint to the bottom of the feet as shown in FIG. 11 or vice versa. In another embodiment, the horizontal crosshairs 51 and 56 may intersect the vertical crosshairs 60-64, 70-74 perpendicularly to provide upper and lower line segments of different lengths above and below the horizontal crosshairs 51 and 56 for ranging a target object at a selected full height and at one or more other selected heights different than a half height.

Figure 12:
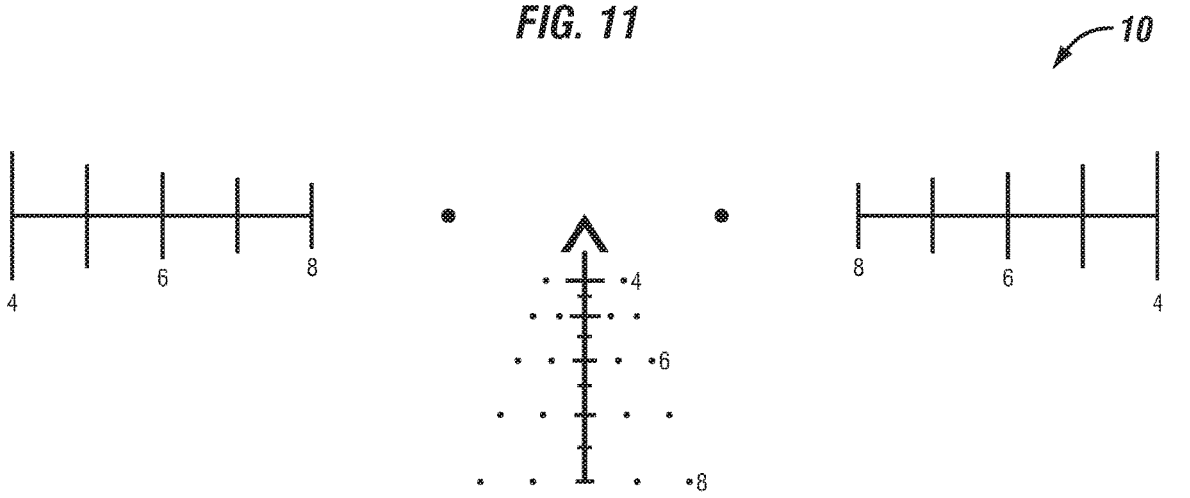
FIG. 12 is a plan view of another embodiment of the reticle of the present application.

Similar as the central scale, the first and second side scales 50, 55 may also include distance numerals for visually indicating to a user ranging distance information for one or more particular vertical crosshairs 60-64, 70-74. With reference to FIG. 8, a number "4" may be located above vertical crosshairs 60 and 70, whereby the number "4" represents a distance of 400.0 meters. Likewise, a number "6" may be located above vertical crosshairs 62 and 72 representing a distance of 600.0 meters and a number "8" may be located above the vertical crosshairs 64 and 74 representing a distance of 800.0 meters. In another embodiment, distance numerals may be located below corresponding vertical crosshairs as shown in FIG. 12. In still another embodiment, distance numerals may be located both above and below corresponding vertical crosshairs.

Figure 13:
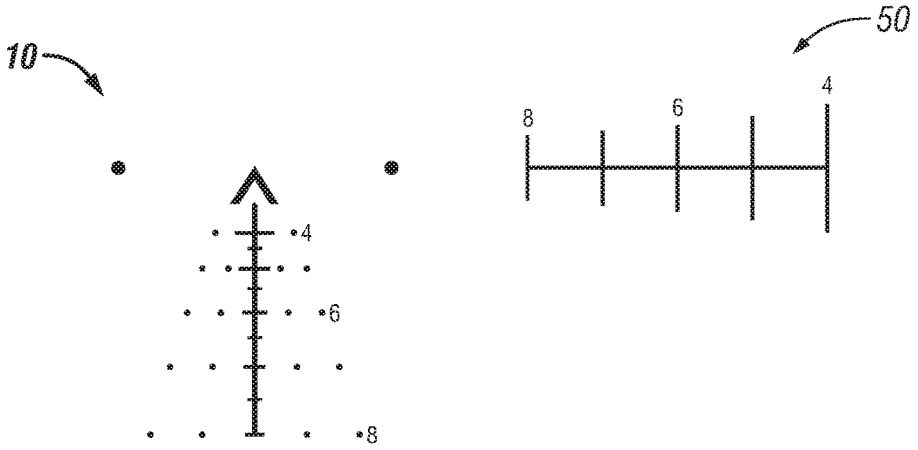
FIG. 13 is a plan view of another embodiment of the reticle of the present application.
Figure 14:
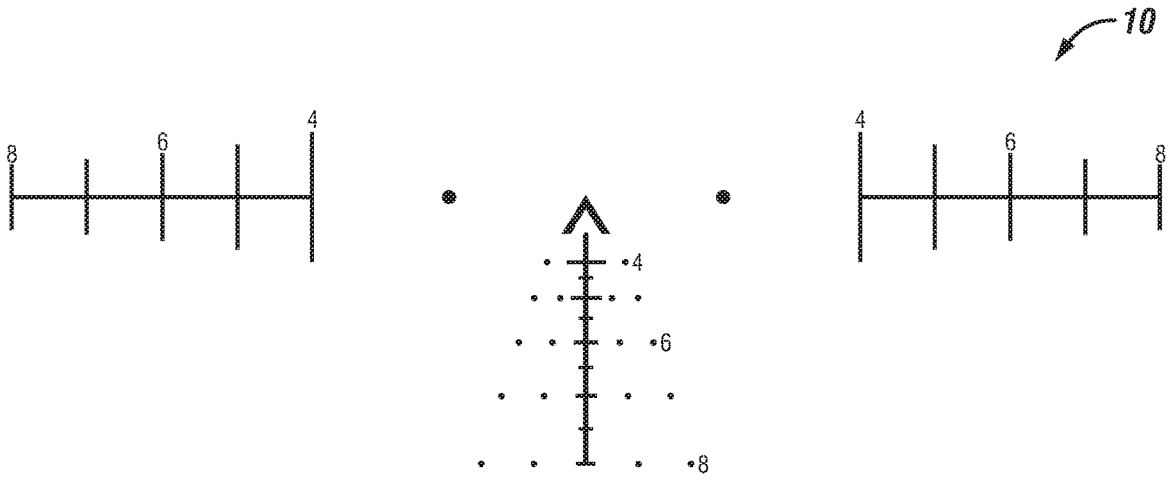
FIG. 14 is a plan view of another embodiment of the reticle of the present application.

Although the horizontal crosshairs 51 and 56 described above are shown each having a length effective to form intersections for each of the vertical crosshairs 60-64 and 70-74. In another embodiment, the horizontal crosshairs 51 and 56 may include lengths greater than or less than the lengths as shown in FIG. 8. It is also contemplated that in another embodiment, the first and second side scales 50, 55 may include an additional vertical crosshair corresponding to the base distance, i.e., 300.0 meters. It is also contemplated that additional vertical crosshairs indicative of other distances may be included for intersecting the horizontal crosshairs 51 and 56 for vertical range estimation purposes as desired. In still another embodiment, a reticle 10 of this application may be provided with a single side scale as shown in FIG. 13. In still another embodiment, the first and second side scales 50, 55 may be provided in reverse order as shown in FIG. 14. In another embodiment, the horizontal crosshairs 51 and 56 and/or the vertical crosshairs 60-64 and 70-74 may be provided as broken lines rather than solid lines.

Another novel feature of the present reticle 10 includes what may be referred to herein as "undetected target guidance" or "target guidance" whereby a first individual in possession of a first reticle 10 may assist another individual in possession of a second reticle 10 in detecting a target object such as an enemy combatant 99 in real time. For example, where two individuals with firearms both of which are equipped with the reticle 10 are actively attempting to locate a common enemy combatant 99, a first individual may identify the enemy combatant 99 and then assist the second individual in locating the enemy combatant 99 by first referencing a particular object visible to both individuals (hereafter "reference point") and then use the various indicia of the reticle 10 to locate the enemy combatant 99 in relation to the reference point.

Figure 15:
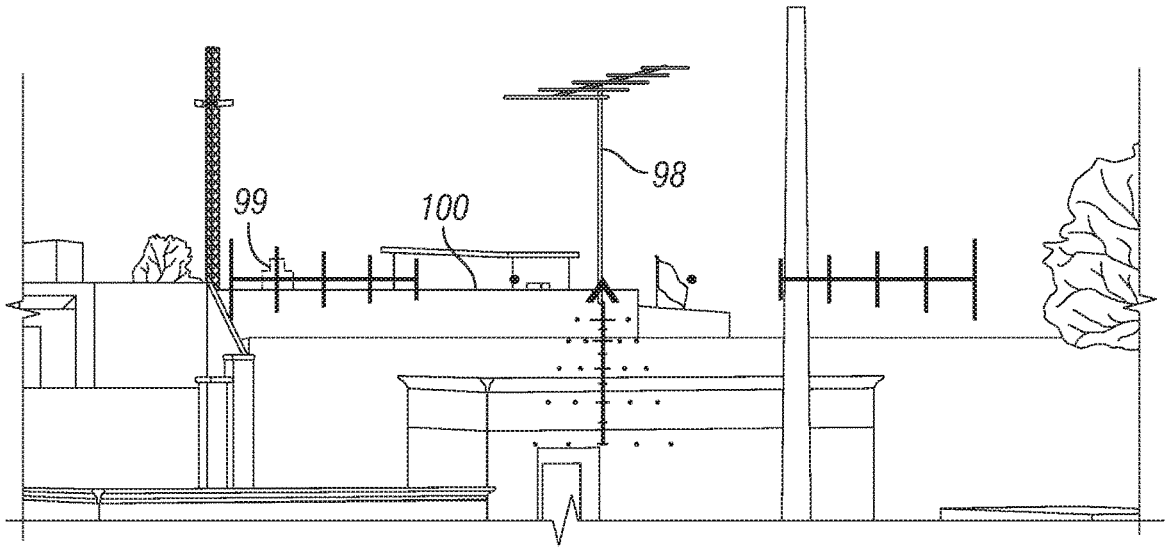
FIG. 15 is a simplified illustration of the reticle of FIG. 1 exemplifying use of the reticle in an urban setting.

With reference to FIG. 15, in one simplified example using the reticle 10 in an urban setting, a first individual may locate an enemy combatant 99 on a rooftop 100. If the second individual cannot locate the enemy combatant 99 then the first individual may identify a reference point such as an antenna pole 98 on the rooftop 100 identifiable to the second individual to provide the second individual with a reference point for initial aiming of the central aiming marker 15. In particular, the first individual may instruct the second individual to aim the central aiming marker 15 at an intersection between the rooftop 100 and the antenna pole 98 as shown. The first individual may then instruct the second individual as to the location of the enemy combatant 99 using the indicia of the reticle 10, e.g., instructing the second individual to look at the second outermost vertical crosshair from the left on the second side scale 55 in order to locate the enemy combatant 99 at a position on the rooftop 100 to the left of the antenna pole 98. Once the second individual locates the enemy combatant 99, the second individual may then relocate the reticle 10 as described above for horizontal and/or vertical ranging of the enemy combatant 99.

Figure 16:
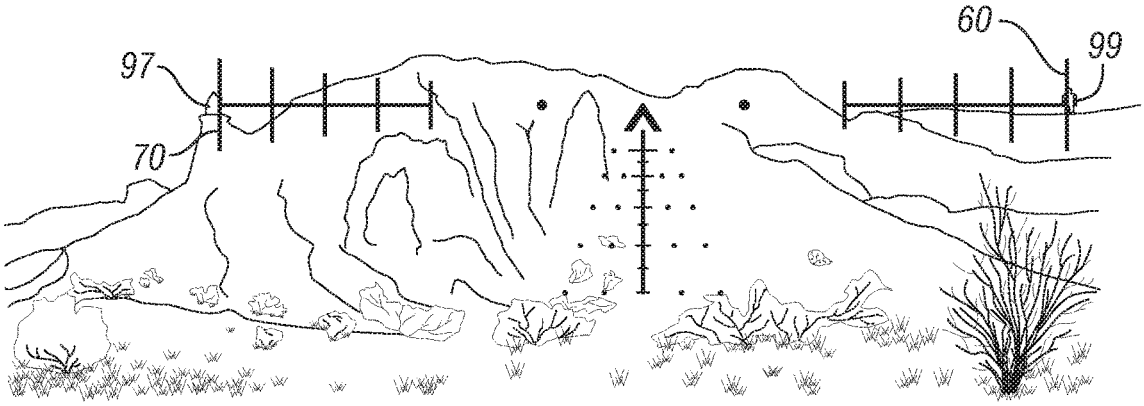
FIG. 16 is a simplified illustration of the reticle of FIG. 1 exemplifying use of the reticle in a rural setting.

Although the reticle 10 may be provided with a single side scale as shown in FIG. 13, another advantageous feature for the inclusion of both the first and second side scales 50, 55 is the breadth or total width of the reticle 10 as provided by the inclusion of each side scale for purposes of locating a target object. In the scenario of FIG. 15, the distance between the reference point and the enemy combatant 99 allowed for use of the central aiming marker 15 and a single side scale. However, in another scenario a usable reference point may be at a greater distance from an enemy combatant 99 than as described above in reference to FIG. 15 whereby both the first and second side scales 50, 55 must be employed for target guidance. In this scenario, one side scale may be used to identify a reference point and the opposite side scale may be used to locate an enemy combatant 99 in relation thereto. For example, as shown in FIG. 16 if a second individual cannot locate a particular enemy combatant 99 that has been located by a first individual, the first individual may identify a usable reference point such as a tall rock feature 97 located far left of an enemy combatant 99 providing the second individual with a reference point for aiming of the outermost vertical crosshair 70 of the second side scale 55. Once the second individual has aimed at the tall rock feature 97 with vertical crosshair 70, the first individual may instruct the second individual as to the location of the enemy combatant 99 in relation to the indicia of the reticle 10 according to this aiming setting. For example, the first individual may instruct the second individual to look at the outermost vertical crosshair 60 on the first side scale 50 to locate the enemy combatant 99.

The horizontal lines, vertical lines, dots and/or other indicia of the reticle 10 may be provided in one or more colors as desired. For example, the reticle 10 may be provided in black color. In another exemplary embodiment, the central aiming marker 15 may be provided in a red color or red illumination. In another exemplary embodiment, the central aiming marker 15 may be provided in a green color or green illumination.

The invention will be better understood with reference to the following non-limiting examples, which are illustrative only and not intended to limit the present invention to a particular embodiment.

Example 1

In a first non-limiting example, a weapon system including a 5.56 mm, magazine-fed, air cooled, semi-automatic rifle operationally configured for accurate non-optic use out to a distance of about 300.0 meters is provided. A reticle 10 as illustrated in FIG. 1 is provided for use with the weapon system whereby the reticle 10 is operationally configured to extend the accuracy of the rifle out to about 800.0 meters. The width of the chevron type central aiming marker 15 at its base 16 is 5.53 MOA corresponding to a center mass of 0.48 meters (19.0 inches) at 300.0 meters. The height of the central aiming marker 15 is 4.10 MOA. The distance between the outer tip 13 and the inner corner 14 of the central aiming marker 15 is 1.46 MOA. The central vertical crosshair 20, the horizontal crosshairs 25, 40, 42, 44, 46, horizontal crosshairs 51, 56 and vertical crosshairs 60, 61, 62, 63, 64, 70, 71, 72, 73, 74 each have a thickness of 0.40 MOA.

Example 2

In a second non-limiting example, a weapon system including a 5.56 mm, magazine-fed, air cooled, semi-automatic rifle is provided with a military mil-dot reticle as understood by persons of ordinary skill in the art of firearm optics and sights. Desired target acquisition requires one or more calculations resulting in a time on target of about one minute or more. The military mil-dot reticle is replaced with a reticle 10 as shown in FIG. 1. The time on target using the reticle 10 is decreased at least in half because the reticle 10 is calculation free whereby bullet drop compensation, horizontal range estimation, vertical range estimation, wind adjustment information, target travel speed lead information, and fire correction information are pre-set parameters of the reticle 10 and correlated for real time target acquisition by a user of the weapon system and reticle 10.

Example 3

Figure 17:
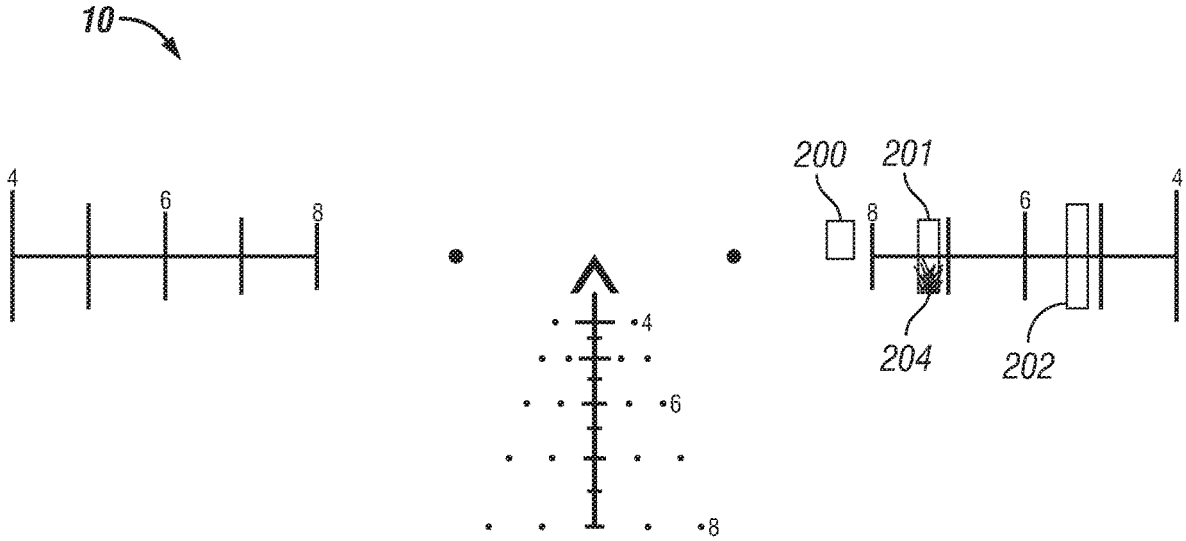
FIG. 17 is a simplified illustration of the reticle of FIG. 1 in use with a weapon system illustrating the ranging of target objects at different distances apart from the location of the reticle.

In a third non-limiting example, a weapon system including a 5.56 mm, magazine-fed, air cooled, semi-automatic rifle operationally configured for accurate non-optic use out to a distance of about 300.0 meters is provided. A reticle 10 as illustrated in FIG. 17 is provided for use with the weapon system whereby the reticle 10 is operationally configured to extend the accuracy of the rifle out to about 800.0 meters in relation to a target object having a height of 1.7 meters. FIG. 17 depicts vertical ranging of various target objects including (1) a target object 200 at a distance of 1600.0 meters from the reticle 10; (2) a partially exposed target object 201 at a distance of 700.0 meters from the reticle 10 (see bush 204 partially obstructing the target object 201); and (3) a target object 202 at a distance of 500.0 meters from the reticle 10.

Example 4

Figure 18:
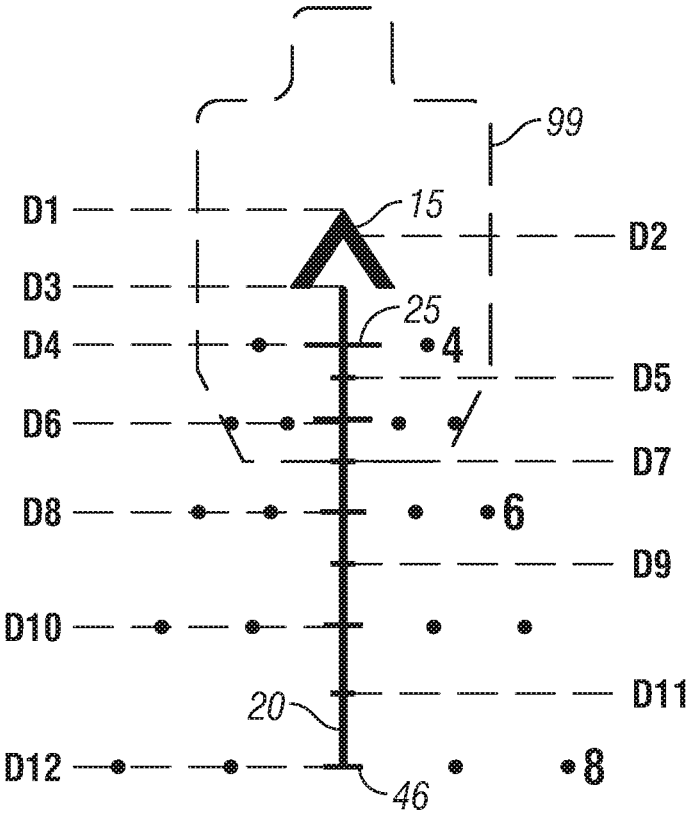
FIG. 18 is a simplified illustration of part of an embodiment of the reticle of the present application for use with a weapon system illustrating a range of bullet drop compensation marks and the distances related thereto.

In a fourth non-limiting example, the central scale of the reticle 10 of Example 3 is provided in FIG. 18 including a range of bullet drop compensation marks representing distances out to 800.0 meters along the central scale. The bullet drop compensation distances at each of the marks are as follows:

D1: 100.0 meters;
D2: 200.0 meters;
D3: 300.0 meters;
D4: 400.0 meters;
D5: 450.0 meters;
D6: 500.0 meters;
D7: 550.0 meters;
D8: 600.0 meters;
D9: 650.0 meters;
D10: 700.0 meters;
D11: 750.0 meters;
D12: 800.0 meters.

Example 5

Figure 19:
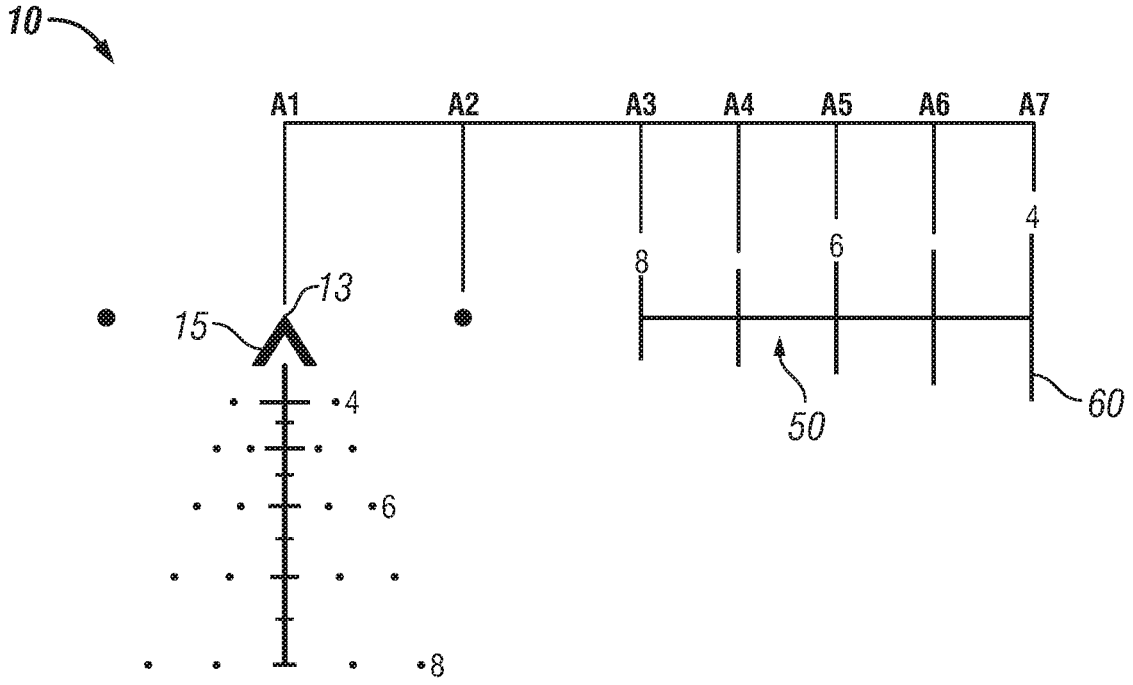
FIG. 19 is a simplified illustration of an embodiment of the reticle of the present application for use with a weapon system illustrating angular measurements in milliradians.

In a fifth non-limiting example, a reticle 10 is provided as shown in FIG. 19 including angular measurements in milliradians from the uppermost part 13 of the central aiming marker 15 to each of the vertical crosshairs 60, 61, 62, 63, 64 (or "angular measurement marks") of the first side scale 50. The angular measurements at each of the angular measurement marks are as follows:

A1: 0.0 MIL;
A2: 5.0 MIL;
A3: 10.0 MIL;
A4: 12.5 MIL;
A5: 15.0 MIL;
A6: 17.5 MIL;
A7: 20.0 MIL.

The above angular measurements may also apply to vertical crosshairs 70, 71, 72, 73, 74 of the second side scale 55 in another embodiment of the reticle 10 as shown in FIG. 1.

Example 6

Figure 20:
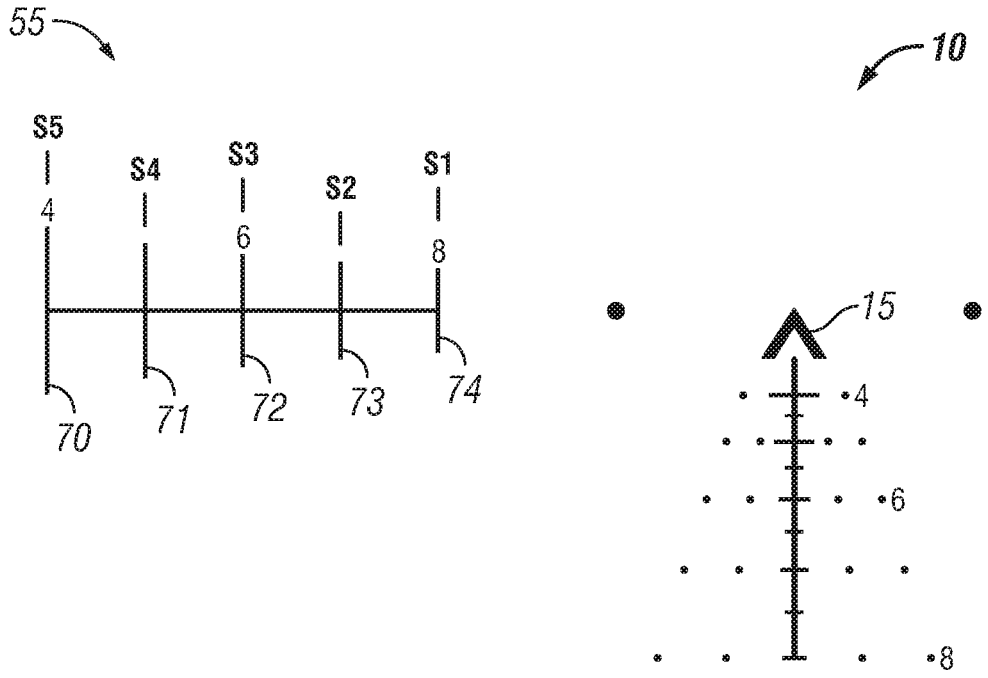
FIG. 20 is a simplified illustration of an embodiment of the reticle of the present application for use with a weapon system including moving target lead marks for a target object moving left to right at speeds from 32.2 km/h (20.0 mph) to 64.4 km/h (40.0 mph).

In a sixth non-limiting example, a reticle 10 with an effective range of 100.0 meters is provided as shown in FIG. 20 including a second side scale 55 including vertical crosshairs 70-74 operationally configured for use as moving target lead marks for purposes of target acquisition of a target object such as a mounted target object moving left to right at speeds up to 64.4 km/h (40.0 mph). The vertical crosshairs 70-74 correlate to the following speeds of a target object:

S1: 32.2 km/h (20.0 mph);
S2: 40.2 km/h (25.0 mph);
S3: 48.3 km/h (30.0 mph);
S4: 56.3 km/h (35.0 mph);
S5: 64.4 km/h (40.0 mph).

Example 7

In a seventh non-limiting example, a reticle 10 as shown in FIG. 1 including angular measurements as described in Example 5 is provided for purposes of fire correction. In this example, a first individual at a first location is unsuccessfully firing one or more rounds at a target object, e.g., an artillery strike. A second individual at a second location may use the reticle 10 to range and aim at the target object for purposes of sighting realized hit locations of one or more rounds fired by the first individual and for assisting the first individual to adjust the angle of sight necessary to hit the target object. With reference to FIG. 16, in a scenario where the first individual fires a first round at an enemy combatant 99 and the round hits the tall rock feature 97, the second individual using the reticle 10 can instruct the first individual to correct right 40.0 MILS for purposes of firing another round at the enemy combatant 99.

Example 8

Figure 21:
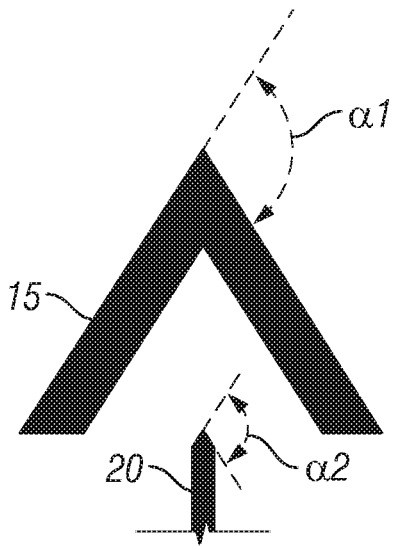
FIG. 21 is a plan view of a central aiming marker and an upper part of a central vertical crosshair of the reticle of FIG. 1.

In an eighth non-limiting example, the reticle 10 of FIG. 1 includes a central aiming marker 15 and a central vertical crosshair 20 with angles as listed below in reference to FIG. 21:

$\alpha 1$: 112.0 degrees;
$\alpha 2$: 112.0 degrees.

Persons of ordinary skill in the art will recognize that many modifications may be made to the present application without departing from the spirit and scope of the invention. The embodiment(s) described herein are meant to be illustrative only and should not be taken as limiting the invention, which is defined in the claims.

I claim:

1. A firearm reticle including:

a central scale operationally configured for horizontal range estimation and aiming of a target according to a selected center mass of the target at one or more predetermined distances; and one or more side scales operationally configured for vertical range estimation of the target according to a selected full height and half height of the target at the one or more predetermined distances;

the central scale including a first measurement mark for horizontal range estimation of the target at a base distance, wherein the first measurement mark is operationally configured to provide one or more target aiming points at one or more distances other than the base distance.

2. The firearm reticle of claim 1 wherein the first measurement mark is operationally configured to provide one or more target aiming points at one or more distances less than the base distance.

3. The firearm reticle of claim 1 wherein the central scale further includes a second measurement mark operationally configured to provide a target aiming point at the base distance.

4. The firearm reticle of claim 1 wherein the central scale further includes one or more bullet drop compensation marks operationally configured for horizontal range estimation of the target according to the selected center mass of the target at one or more incremental distances greater than the base distance.

5. The firearm reticle of claim 1 wherein the one or more side scales include one or more vertical marks operationally configured for vertical range estimation of the target at one or more incremental distances greater than the base distance according to the selected height and half the selected height, wherein the one or more vertical marks are operationally configured as lead marks.

6. The firearm reticle of claim 4 wherein the one or more side scales include one or more vertical marks operationally configured for vertical range estimation of the target at the one or more incremental distances according to the selected full height and half height, wherein the one or more vertical marks are operationally configured as lead marks.

7. The firearm reticle of claim 1 further including a set of lead marks on opposing sides of the first measurement mark, the center of each lead mark being set in horizontal alignment with an uppermost part of the first measurement mark.

8. The firearm reticle of claim 4 wherein the central scale includes wind adjustment marks corresponding to each of the one or more bullet drop compensation marks.

9. The firearm reticle of claim 4 including a bullet drop compensation mark operationally configured as a wind adjustment mark.

10. The firearm reticle of claim 5 wherein the one or more vertical marks provide angular measurements from the uppermost part of the first measurement mark.

11. A firearm reticle for acquisition of a target having pre-set parameters including horizontal range estimation information, vertical range estimation information, bullet drop compensation information, wind adjustment information, target travel speed lead information, and fire correction information according to a particular package, the reticle having a central scale including (1) a first measurement mark operationally configured to horizontally range estimate the target according to a predetermined average center mass of the target at a base distance of the reticle and provide a first target aiming point and a second target aiming point of the reticle at distances other than the base distance and (2) a second measurement mark operationally configured to provide a third target aiming point of the reticle at the base distance.

12. The firearm reticle of claim 11 further including a third measurement mark including one or more lead marks operationally configured to vertically range estimate the target at one or more distances greater than the base distance according to a selected full height and half height of the target.

13. The firearm reticle of claim 11 further including a third measurement mark including one or more angular measurement marks operationally configured to vertically range estimate the target at one or more distances greater than the base distance according to a selected full height and half height of the target.

14. A calculation free method of decreasing time on target for a user of a firearm comprising:

providing a firearm reticle for use with a firearm of a particular package, the firearm reticle having pre-set parameters including horizontal range estimation information, vertical range estimation information, bullet drop compensation information, wind adjustment information, target travel speed lead information, and fire correction information, the reticle having a central scale including (1) a first measurement mark operationally configured to horizontally range the target according to a predetermined average center mass of the target at a base distance of the reticle and provide a first target aiming point and a second target aiming point of the reticle at distances other than the base distance, (2) a second measurement mark operationally configured to provide a third target aiming point of the reticle at the base distance, and (3) one or more side scales including a one or more vertical marks operationally configured to vertically range the target according to a selected full height and half height of the target at one or more distances other than the base distance, wherein the one or more vertical marks are operationally configured as lead marks and as angular measurement marks from the first measurement mark; and acquiring a target using the reticle according to the firing position of the target, the distance of the target from the reticle and observed cross wind velocity.

15. The method of claim 14 wherein fire correction information is provided according to the angular measurements of the one or more vertical marks of the one or more side scales.

* * * * *